US009823620B2

(12) United States Patent
Tanaka

(10) Patent No.: US 9,823,620 B2
(45) Date of Patent: Nov. 21, 2017

(54) IMAGE FORMING APPARATUS WITH DETACHABLE FIXING DEVICE

(71) Applicant: CANON KABUSHIKI KAISHA, Tokyo (JP)

(72) Inventor: Hirotomo Tanaka, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/297,412

(22) Filed: Oct. 19, 2016

(65) Prior Publication Data

US 2017/0038713 A1 Feb. 9, 2017

Related U.S. Application Data

(63) Continuation of application No. 14/808,196, filed on Jul. 24, 2015, now Pat. No. 9,507,317.

(30) Foreign Application Priority Data

Jul. 28, 2014 (JP) ..... 2014-152913

(51) Int. Cl.
*G03G 21/00* (2006.01)
*G03G 21/16* (2006.01)
*G03G 15/00* (2006.01)

(52) U.S. Cl.
CPC ..... *G03G 21/1685* (2013.01); *G03G 15/5016* (2013.01); *G03G 15/5066* (2013.01); *G03G 2221/1639* (2013.01)

(58) Field of Classification Search
CPC ..... G03G 15/5016; G03G 21/1685; G03G 2215/00514; G03G 2221/1639
(Continued)

(56) References Cited

U.S. PATENT DOCUMENTS 5,305,065 A 4/1994 Hoover et al.
6,016,409 A 1/2000 Beard
(Continued)

FOREIGN PATENT DOCUMENTS

JP 4219775 A 8/1992
JP 2007065598 A 3/2007
(Continued)

OTHER PUBLICATIONS

Office Action issued in U.S. Appl. No. 14/808,196, mailed Oct. 6, 2015.

(Continued)

*Primary Examiner* — Robert Beatty
(74) *Attorney, Agent, or Firm* — Rossi, Kimms & McDowell LLP

(57) ABSTRACT

An image forming apparatus with a detachable fixing device that is capable of printing with high quality without printing wastefully. A storage unit stores identification information about a fixing device in association with an attribute of a sheet that is printable with the fixing device concerned. A control unit executes printing when the storage unit does not store an attribute of a sheet corresponding to a fixing device that is currently attached to the image forming apparatus. The control unit determines whether to execute printing according to an attribute of a sheet used in printing and an attribute of a sheet stored in the storage unit when the storage unit stores the attribute of the sheet corresponding to the fixing device that is currently attached to the image forming apparatus.

36 Claims, 21 Drawing Sheets

(58) Field of Classification Search
USPC ..... 399/12, 45, 122
See application file for complete search history.

(56) References Cited

U.S. PATENT DOCUMENTS

| | | | |
|---|---|---|---|
| 8,090,273 | B2 | 1/2012 | Derimiggio |
| 8,559,838 | B2 | 10/2013 | Ogawahara |
| 8,705,130 | B2 | 4/2014 | Miyazaki |
| 2003/0077087 | A1 | 4/2003 | Clark |
| 2004/0240893 | A1 | 12/2004 | Sato |
| 2011/0058201 | A1 | 3/2011 | Mueller |
| 2012/0076510 | A1 | 3/2012 | Mizuno |
| 2013/0142534 | A1 | 6/2013 | Isobe et al. |

FOREIGN PATENT DOCUMENTS

| | | | |
|---|---|---|---|
| JP | 2010211087 | A | 9/2010 |
| JP | 2011056945 | A | 3/2011 |
| JP | 2011128189 | A | 6/2011 |
| JP | 2013088683 | A | 5/2013 |
| JP | 2013088733 | A | 5/2013 |

OTHER PUBLICATIONS

Office Action issued in U.S. Appl. No. 14/808,196, mailed Apr. 15, 2016.
Notice of Allowance issued in U.S. Appl. No. 14/808,196, mailed Jul. 22, 2016.
Notice of Allowance issued in U.S. Appl. No. 15/617,125 dated Jul. 13, 2017.

*FIG. 6*

600

| FIXING DEVICE IDENTIFYING SIGNAL | NAME | PRINTABLE SHEET SETTING | |
|---|---|---|---|
| 00000003 | A4/A3 FIXING DEVICE | A4 | PLAIN PAPER |
| | | A3 | PLAIN PAPER |
| | | A4 | COATED PAPER |
| | | A4 | RECYCLED PAPER |
| 10000008 | ENVELOPE FIXING DEVICE | ENVELOPE | ENVELOPE |

601 602 603 604

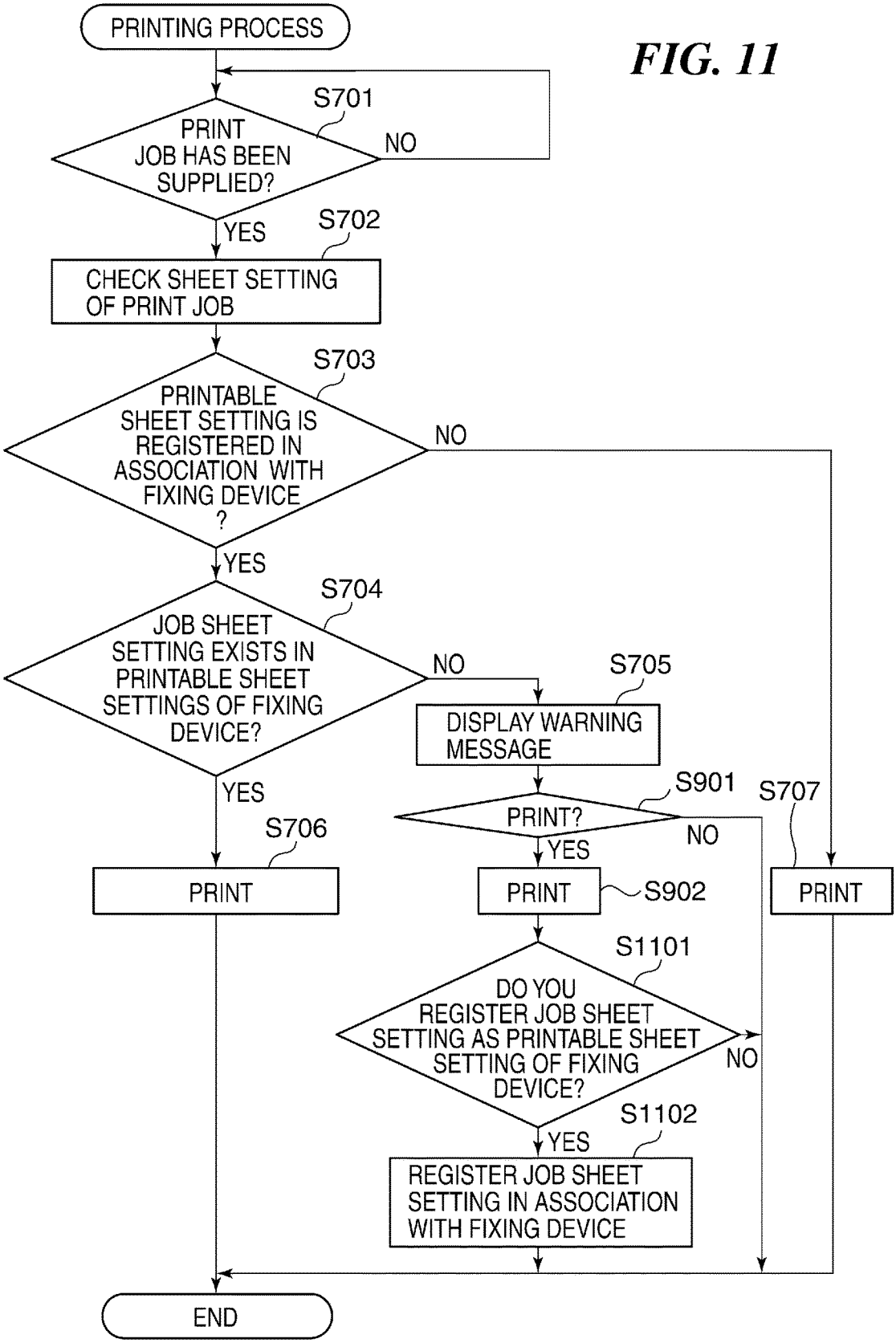
PRINTING PROCESS
FIG. 11
S701
PRINT JOB HAS BEEN SUPPLIED?
NO
YES
S702
CHECK SHEET SETTING OF PRINT JOB
S703
PRINTABLE SHEET SETTING IS REGISTERED IN ASSOCIATION WITH FIXING DEVICE ?
NO
YES
S704
JOB SHEET SETTING EXISTS IN PRINTABLE SHEET SETTINGS OF FIXING DEVICE?
NO
S705
DISPLAY WARNING MESSAGE
YES
S901
PRINT?
NO
S707
S706
YES
PRINT
PRINT
S902
PRINT
S1101
DO YOU REGISTER JOB SHEET SETTING AS PRINTABLE SHEET SETTING OF FIXING DEVICE?
NO
S1102
YES
REGISTER JOB SHEET SETTING IN ASSOCIATION WITH FIXING DEVICE
END

IMAGE FORMING APPARATUS WITH DETACHABLE FIXING DEVICE

BACKGROUND OF THE INVENTION

Field of the Invention

The present invention relates to an image forming apparatus that allows an operator to exchange fixing devices, a control method therefor, and a storage medium storing a control program therefor.

Description of the Related Art

An image forming apparatus called an MFP (Multi Function Printer) equipped with functions, such as a printer, scanner, and facsimile, is used widely in recent years. Some of such image forming apparatuses enable attachment and detachment of a plurality of kinds of fixing devices.

There are two reasons to enable attachment and detachment of a plurality of kinds of fixing devices to an image forming apparatus as follows. The first reason is to use the optimal fixing device according to a sheet type. For example, when a special sheet like an envelope is used for printing, a fixing device optimal to the special sheet is used. Since an envelope is made by folding a sheet and pasting its edges, an envelope is thicker than a normal sheet. Accordingly, when an envelope is printed with a fixing device (hereinafter referred to as a normal fixing device) that is used for a normal sheet with a general thickness, a pasted portion may deviate when passing through the fixing device, which may cause a wrinkle on the envelope.

In order to prevent such a wrinkle, a fixing device (hereinafter referred to as an envelope fixing device) that is dedicated to an envelope is prepared. Holding pressure to a sheet passing through the fixing device is set low in the envelope fixing device to prevent a wrinkle on an envelope.

The second reason is not to stop the operation of an image forming apparatus for long time due to a defect of a fixing device. In a field of a production print, it is required to print printed matter in massive pages or massive number of copies. Accordingly, when a defect occurs in a fixing device, an image forming apparatus is restored from a trouble in short time by exchanging fixing devices without repairing the defect part. Accordingly, an operator prepares a plurality of fixing devices at an operation site of an image forming apparatus, and is employing the image forming apparatus.

In this way, in the print-on-demand market in which an operator always resides, a plurality of fixing devices are prepared for an image forming apparatus, and the operator exchanges fixing devices when a defect occurs in a fixing device. In such environment, there is a known image forming apparatus that corrects difference in color tones of fixing devices (see Japanese Laid-Open Patent Publication (Kokai) No. 2013-088683 (JP 2013-088683A)). The image forming apparatus identifies the type of a fixing device, reads a gamma correction chart corresponding to the identified type of the fixing device, and applies gamma correction to image data. In the print-on-demand market in which a plurality of fixing devices are exchanged and employed, it is effective to identify a fixing device and to correct according to characteristics of the fixing device.

As mentioned above, the image forming apparatus disclosed in the publication prepares the correction data for every fixing device, and is trying to adjust the color tone corresponding to a fixing device. However, the image forming apparatus disclosed in the above-mentioned publication does not consider an effect of a relation between a fixing device and a sheet in the color tone. As mentioned above, when printing on an envelope, the image forming apparatus needs to be equipped with an envelope fixing device in order to prevent a wrinkle. However, the image forming apparatus disclosed in the above-mentioned publication cannot check whether the sheet type corresponding to a print job is the same as the sheet type allocated to a fixing device attached to the image forming apparatus. As a result, the image forming apparatus may not print suitably on some sheets.

Furthermore, some operators employ the image forming apparatus by using different fixing devices separately according to a sheet size or a sheet size series. In such a case, even when a normal fixing device is used, continuous printing on sheets of the same size may cause a scratch (edge scratch) that is the cause of output unevenness on a fixing roller.

Accordingly, when a fixing device that repeats printing on sheets of the same size fixes a toner image onto a sheet of the larger size, output unevenness caused by the repeated printing may occur in an output matter.

In order to avoid a wrinkle of an envelope and output-unevenness resulting from difference in sheet sizes at the time of printing, it is necessary to select a fixing device suitable for the type and size of a sheet defined by a print job as mentioned above. However, the image forming apparatus disclosed in the above-mentioned publication prints without considering an employment of a fixing device according to the type and size of a sheet, which reduces gross, weakens an adhesion of toner, and causes output unevenness in an output matter.

SUMMARY OF THE INVENTION

The present invention provides an image forming apparatus, a control method therefor, and a storage medium storing a control program therefor, which are capable of printing with high quality without printing wastefully.

Accordingly, a first aspect of the present invention provides an image forming apparatus with a detachable fixing device comprising a storage unit configured to store identification information about a fixing device in association with an attribute of a sheet that is printable with the fixing device concerned, and a control unit configured to execute printing when the storage unit does not store an attribute of a sheet corresponding to a fixing device that is currently attached to the image forming apparatus, and to determine whether to execute printing according to an attribute of a sheet used in printing and an attribute of a sheet stored in the storage unit when the storage unit stores the attribute of the sheet corresponding to the fixing device that is currently attached to the image forming apparatus.

Accordingly, a second aspect of the present invention provides a control method for an image forming apparatus with a detachable fixing device, the control method comprising storing identification information about a fixing device in association with an attribute of a sheet that is printable with the fixing device concerned into a storage unit, executing printing when the storage unit does not store an attribute of a sheet corresponding to a fixing device that is currently attached to the image forming apparatus, and determining whether to execute printing according to an attribute of a sheet used in printing and an attribute of a sheet stored in the storage unit when the storage unit stores the attribute of the sheet corresponding to the fixing device that is currently attached to the image forming apparatus.

Accordingly, a third aspect of the present invention provides a non-transitory computer-readable storage medium storing a control program causing a computer to execute the control method of the second aspect.

According to the present invention, when the same sheet setting as the job sheet setting set by the print job does not exist in the printable sheet setting of the fixing device, an operator is notified of the warning message indicating that a fixing device for the same sheet setting is not attached to the image forming apparatus. Accordingly, an operator easily grasps that the job sheet setting set by the print job differs from the printable sheet setting of the fixing device attached to the image forming apparatus at the time of printing. This enables to print with high quality without printing wastefully.

Further features of the present invention will become apparent from the following description of exemplary embodiments with reference to the attached drawings.

BRIEF DESCRIPTION OF THE DRAWINGS

FIG. 6 is a view showing an example of a fixing-device management table saved in a data storage module shown in FIG. 4.

FIG. 11 is a flowchart showing a printing process executed by an image forming apparatus according to a third embodiment of the present invention.

DESCRIPTION OF THE EMBODIMENTS

Hereafter, an example of an image forming apparatus according to an embodiment of the present invention will be described with reference to the attached drawings.

Figure 1:
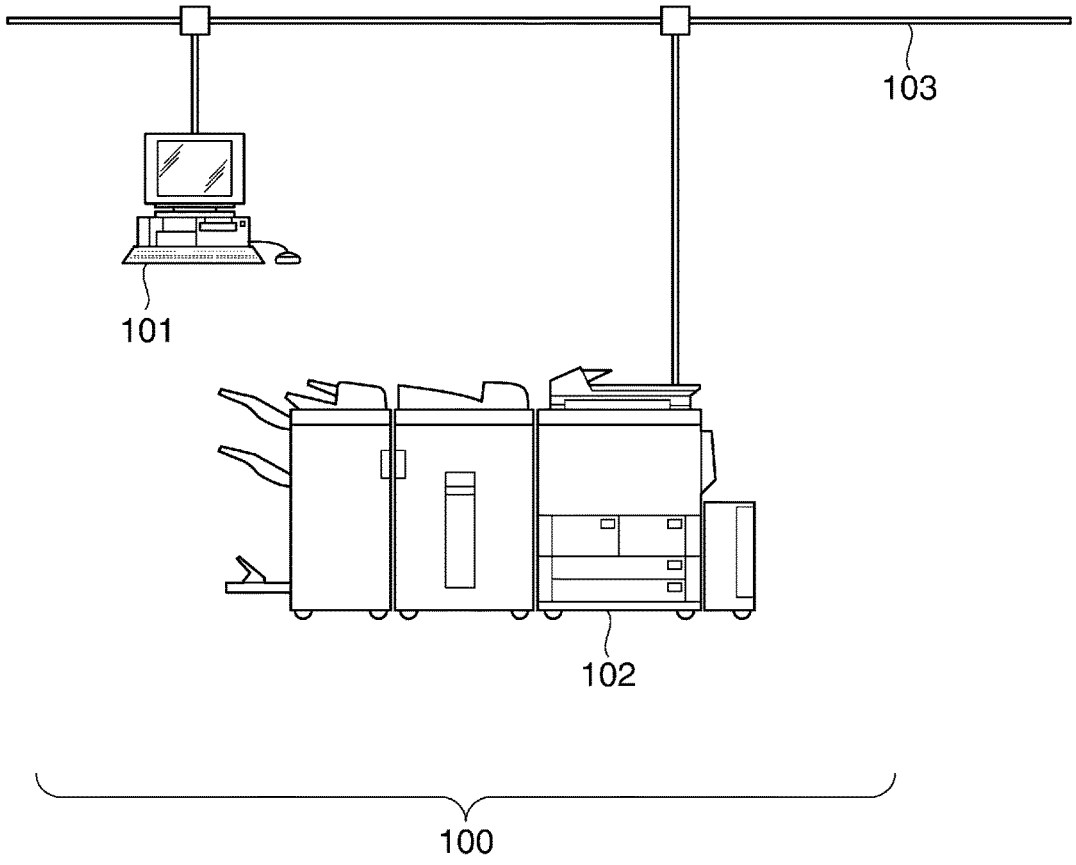
FIG. 1 is a block diagram schematically showing a configuration of an image forming system that employs an image forming apparatus according to a first embodiment of the present invention.

FIG. 1 is a block diagram schematically showing a configuration of an image forming system that employs an image forming apparatus according to a first embodiment of the present invention.

The image forming system 100 has the image forming apparatus (for example, an MFP) 102. A client terminal 101 is connected to the image forming apparatus 102 through a network 103, such as a LAN. A user operates an application on the client terminal 101, and prints by the image forming apparatus 102. Although only one client terminal 101 is shown in the illustrated example, a plurality of client terminals 101 may be connected to the network 103.

Figure 2:
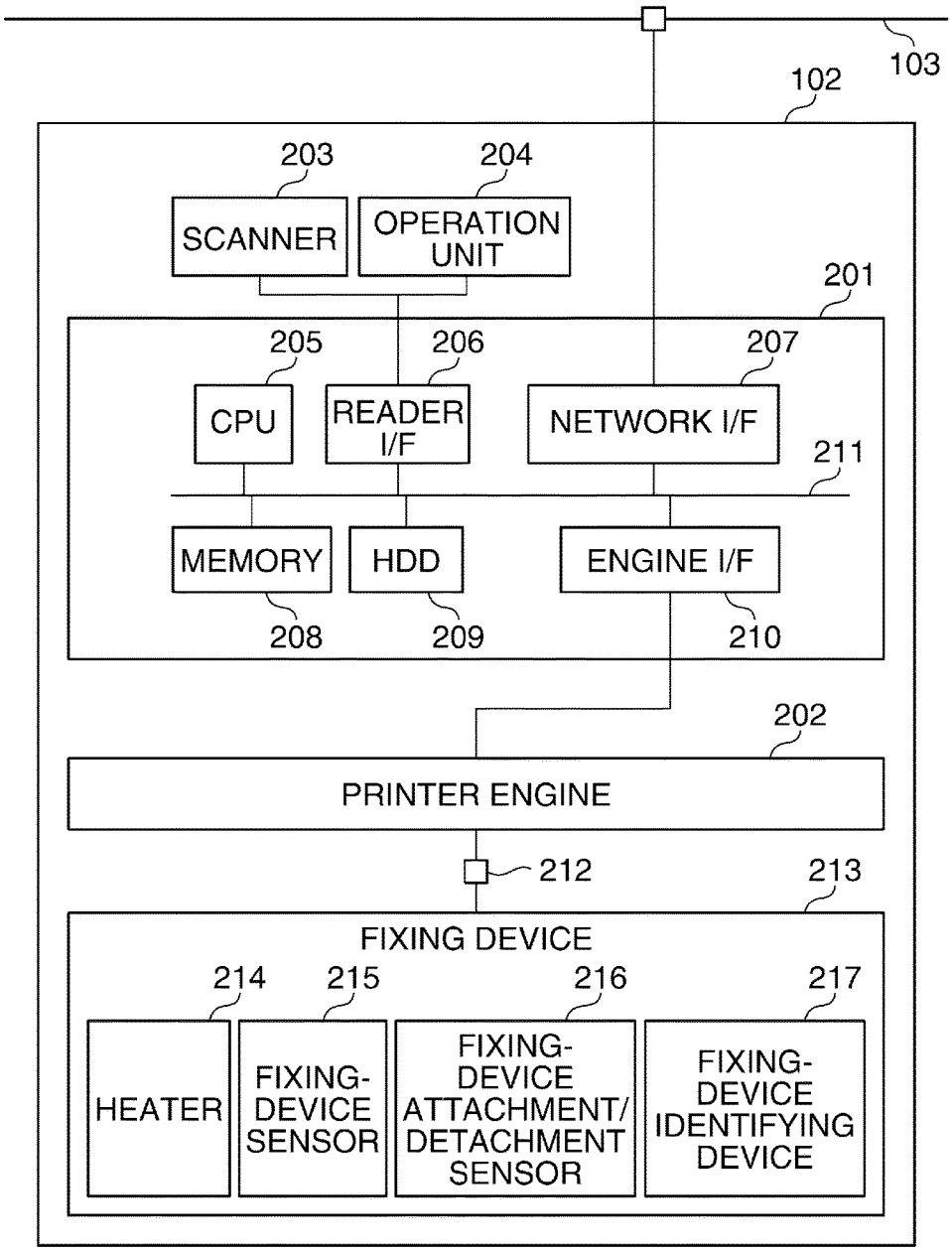
FIG. 2 is a block diagram schematically showing a hardware configuration of the image forming apparatus shown in FIG. 1.

FIG. 2 is a block diagram schematically showing a hardware configuration of the image forming apparatus 102 shown in FIG. 1.

The image forming apparatus 102 is provided with a controller 201, a printer engine 202, a scanner 203, and an operation unit 204. The controller 201 has a central processing unit (CPU) 205. A reader interface (I/F) 206, a network I/F 207, a memory 208, a hard disk drive (HDD) 209, and an engine I/F 210 are connected to the CPU 205 through a system bus 211. The CPU 205 controls the entire image forming apparatus 102. The memory 208 is used as a temporary storage area when the image forming apparatus 102 operates, and is used as a work memory of the CPU 205.

The HDD 209 is a mass storage device, and stores various kinds of control programs executed by the CPU 205. The network I/F 207 communicates with another apparatus, such as the client terminal 101, through the network 103 under control of the CPU 205. An engine I/F 210 communicates with the printer engine 202 under control of the CPU 205. Moreover, the reader I/F 206 communicates with the scanner 203 and the operation unit 204 under control of the CPU 205.

The scanner 203 reads an original set on a tray (not shown) etc., and generates image data. Then, the image data concerned is transmitted to the controller 201 from the scanner 203. The operation unit 204 has buttons, a keyboard, and a touch panel, for example. An operator instructs various operations to the image forming apparatus 102 through the operation unit 204.

The printer engine 202 receives the image data from the controller 201 through the engine I/F 210, and forms an image (for example, a toner image) on a sheet according to the image data concerned. The printer engine is provided with a sheet feeding unit, photoconductive drums, an intermediate transfer belt, and transfer rollers (they are not shown). Furthermore, a fixing device 213 is connected to the printer engine through a port 212.

The fixing device 213 fixes a toner image formed on a sheet, and has a heater 214 and a fixing-device sensor 215 for controlling fixing temperature. Furthermore, the fixing device 213 has a fixing-device attachment/detachment sensor 216 and a fixing-device identifying device 217. The fixing-device attachment/detachment sensor 216 is used for detecting detachment of the fixing device from the image forming apparatus 102. The fixing-device identifying device 217 is used for identifying the fixing device attached to the image forming apparatus 102.

The fixing-device identifying device 217 is a nonvolatile memory installed in the fixing device. A unique ID (identification code) that has been defined for each fixing device is written in the nonvolatile memory concerned.

Figure 3:
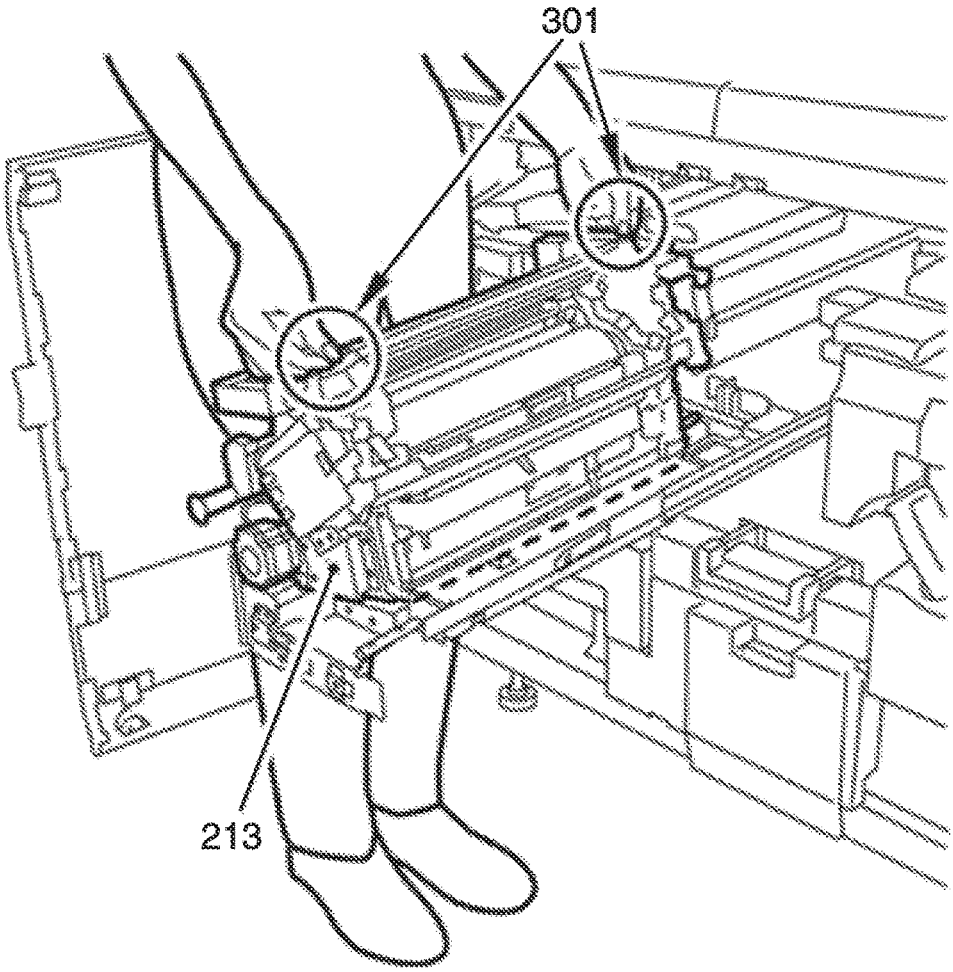
FIG. 3 is a perspective view showing an exchanging work of the fixing devices in the image forming apparatus shown in FIG. 1.

FIG. 3 is a perspective view showing an exchanging work of the fixing device 213 in the image forming apparatus shown in FIG. 1.

An operator holds grips 301 formed on the upper portion of the fixing device 213, pulls out the fixing device 213 to a near side, and exchanges the fixing devices 213.

Figure 4:
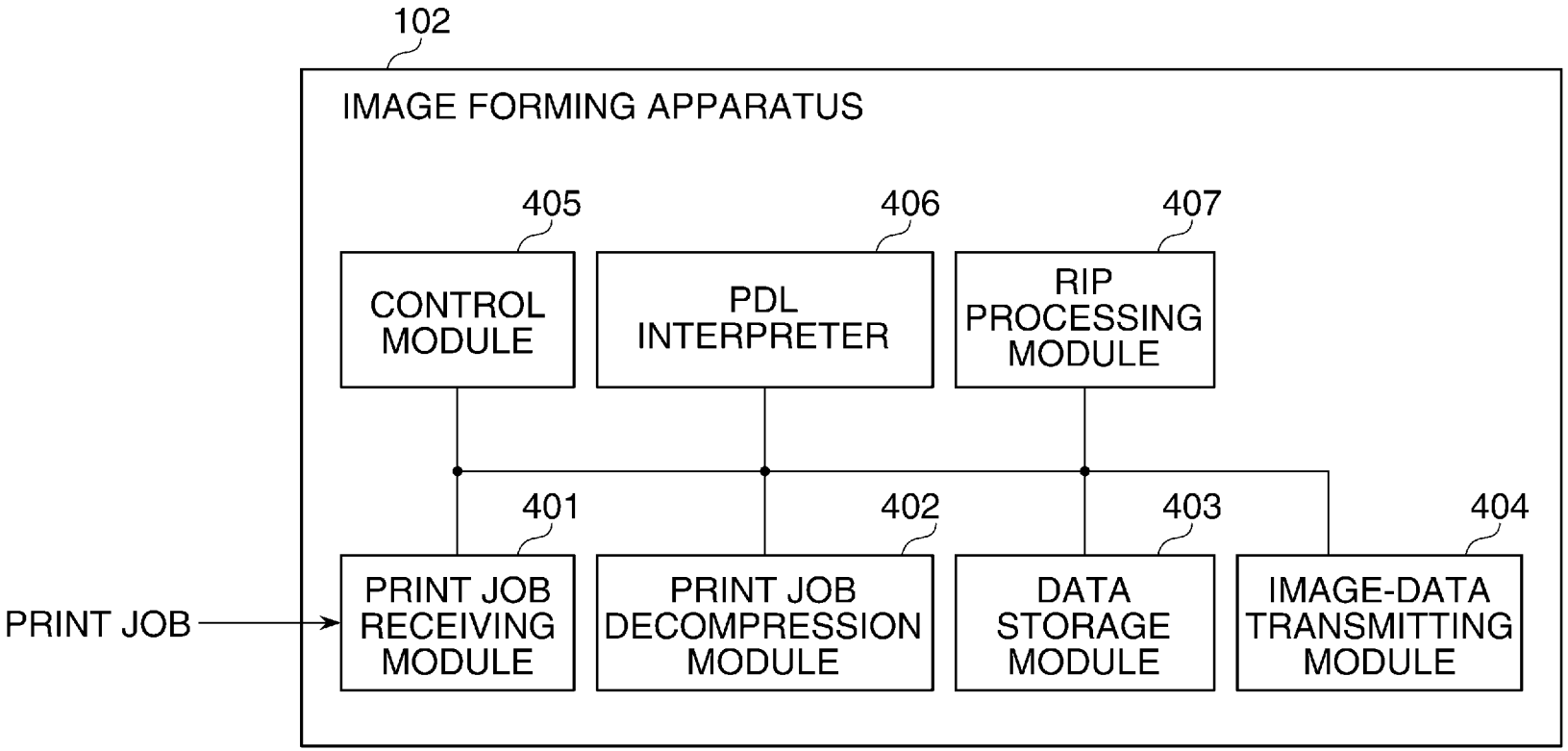
FIG. 4 is a block diagram schematically showing a software configuration used by the image forming apparatus shown in FIG. 1.

FIG. 4 is a block diagram schematically showing a software configuration used by the image forming apparatus 102 shown in FIG. 1.

Each of illustrated software modules is developed onto the memory 208 shown in FIG. 2, and is executed by the CPU 205. A print job receiving module 401 receives a print job transmitted from the client terminal 101 through the network I/F 207. Then, the print job receiving module 401 temporarily stores the print job into a data storage module 403 in the memory 208.

A print job decompression module 402 analyzes the print job stored in the data storage module 403, and then, develops the print job from the data storage module 403 and passes it to a PDL (Page Description Language) interpreter 406. The PDL interpreter 406 develops PDL data included in the print job, and converts it into an intermediate data format.

Here, the PDL data is converted into the PDF (Portable Document Format) of Adobe System Incorporated, for example. A RIP processing module 407 receives the data in the intermediate data format from the PDL interpreter 406, performs a RIP process, and converts it into image data. Then, the RIP processing module 407 temporarily stores the image data concerned in the data storage module 403.

A control module 405 generates a control command to the printer engine 202 about the image data stored in the data storage module 403. Then, the control module 405 sends the control command concerned to the printer engine 202 through the engine I/F 210. An image-data transmitting module 404 transmits the image data to the printer engine 202 through the engine I/F 210. As a result of this, the printer engine 202 executes printing according to the image data. Thus, the image forming apparatus 102 executes printing according to the print job supplied from the client terminal 101.

Hereinafter, an exchange process of a plurality of types of fixing devices will be described.

The fixing device 213 shown in FIG. 2 is detachably attached to the image forming apparatus 102. In this case, the printer engine 202 is equipped with any one of the plurality of types of fixing devices.

For example, the plurality of types of fixing devices include a normal fixing device and an envelope fixing device. A normal fixing device is used when printing on a normal sheet other than an envelope. On the other hand, an envelope fixing device is a fixing device for exclusive use for printing on an envelope. An envelope fixing device is designed so as to lower holding pressure by thinning thicknesses of a pressure roller (not shown) and a fixing film (not shown) in order to prevent a wrinkle.

Since the envelope fixing device has a configuration specialized to an envelope, an adhesion of toner becomes weak when used for a sheets other than an envelope.

Moreover, an operator uses a plurality of normal fixing devices properly according to a sheet size in order to prevent generating a print streak due to an edge scratch that occurs by continuously printing sheets of the same size. Accordingly, the image forming apparatus 102 needs to detect not only the type of the fixing device, but also the size or the size series of the sheets to be used.

When the fixing device 213 is attached, the printer engine 202 receives the signal from the fixing-device attachment/detachment sensor 216 through the port 212, and detects that the fixing device 213 is attached. Then, the printer engine 202 reads the ID registered in the fixing-device identifying device 217 as a fixing-device identifying signal, and outputs it to the control module 405.

The control module 405 identifies the fixing device attached to the image forming apparatus 102 on the basis of the fixing-device identifying signal.

It should be noted that a method other than the above-mentioned method may be used to identify the fixing device attached to the image forming apparatus 102. For example, the fixing devices may have notches of different shapes. In such a case, the image forming apparatus 102 has a sensor that physically detects the shape of the notch to identify the fixing device. Then, the identified result concerned is transmitted to the control module 405.

Next, a process for registering the printable sheet setting (an attribute of a sheet), which includes a name of device, a type and size of printable sheet, will be described. An operator registers the name of the fixing device and the printable sheet setting through the operation unit 204. A plurality of printable sheet settings can be registered in association with one fixing device.

Figure 5A:
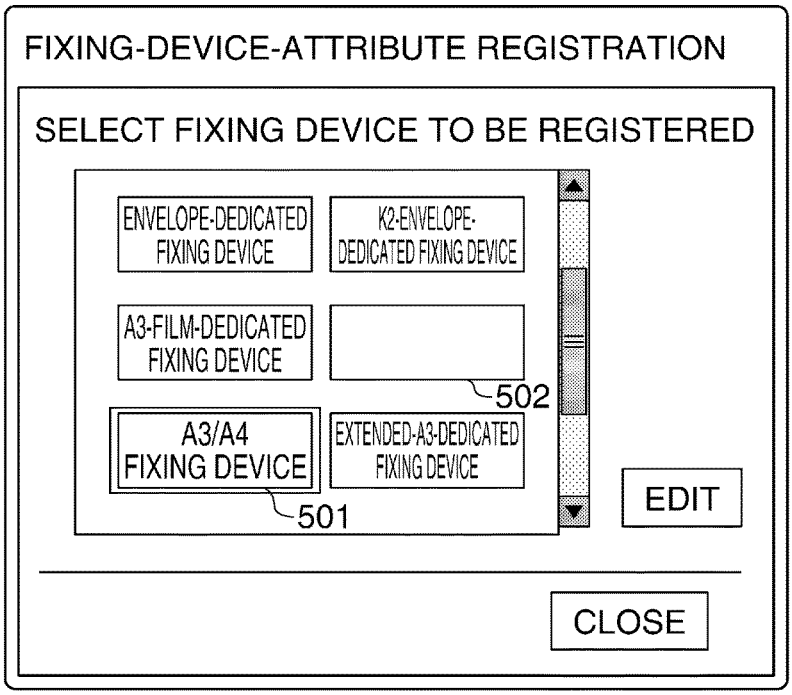
FIG. 5A is a view showing an example of a fixing-device-attribute registration screen displayed on an operation unit shown in FIG. 2.
Figure 5B:
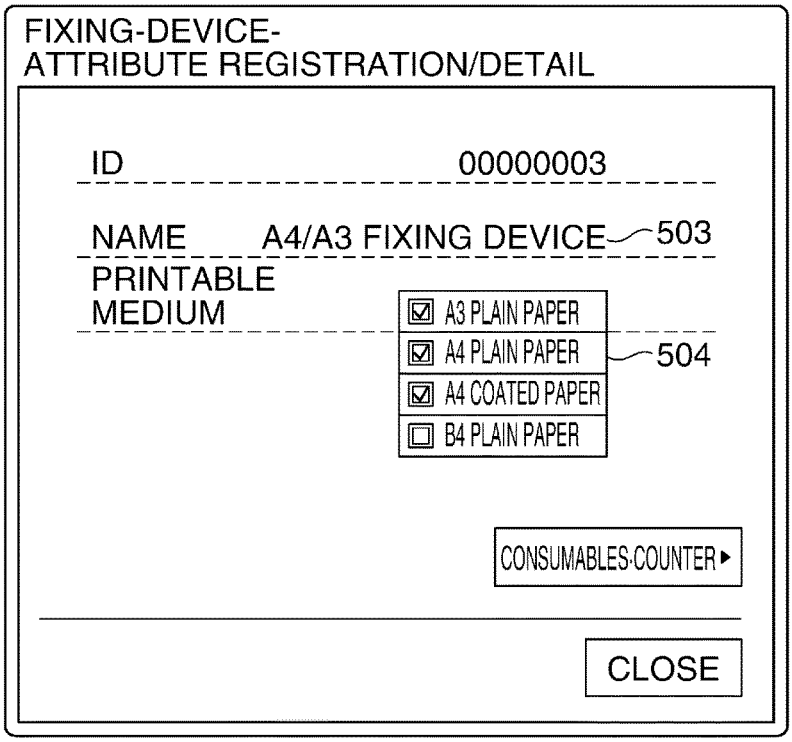
FIG. 5B is a view showing an example of a fixing-device-attribute registration/detail screen displayed on the operation unit shown in FIG. 2.

FIG. 5A is a view showing an example of a fixing-device-attribute registration screen displayed on the operation unit 204 shown in FIG. 2. FIG. 5B is a view showing an example of a fixing-device-attribute registration/detail screen displayed on the operation unit 204.

In the fixing-device-attribute registration screen shown in FIG. 5A, names of fixing devices registered into the below-mentioned fixing-device management table are displayed as buttons. When the fixing device 213 attached to the image forming apparatus 102 has been already registered, the corresponding name is displayed as a doublet button 501. On the other hand, the fixing device 213 is not registered, the doublet button 501 is not displayed. In this case, the operator can register a fixing device by pushing an unregistered button 502.

When the operator selects a button that shows one of fixing devices in the fixing-device-attribute registration screen shown in FIG. 5A and pushes an edit button, a detailed setting screen about the fixing device corresponding to the button is displayed and edit becomes possible. For example, when a button of an A4/A3 fixing device is selected and the edit button is pushed, the control module 405 displays the fixing-device-attribute registration/detail screen shown in FIG. 5B on the operation unit 204. Then, the operator can register details of the attribute of the fixing device through the fixing-device-attribute registration/detail screen.

In the illustrated example, "A4/A3 fixing device" is registered as the name 503, and "A3 plain paper", "A4 plain paper", and "A4 coated paper" are registered as the printable sheet settings 504 of the fixing device of which ID is "00000003". The control module 405 registers the fixing-device identifying signal and its printable sheet settings into the fixing-device management table saved in the data storage module 403 and manages them.

FIG. 6 is a view showing an example of the fixing-device management table saved in the data storage module 403 shown in FIG. 4.

The fixing-device identifying signals (ID) 601, the names 602 of fixing devices, and the printable sheet settings (the sheet sizes 603 and the sheet types 604) are saved in the fixing-device management table 600 shown in FIG. 6. The control module 405 determines whether the attached fixing device is an envelope fixing device or a normal fixing device on the basis of the read ID. For example, as shown in FIG. 6, the most significant digit of the ID of an envelope fixing device is "1", and the most significant digit of the ID of a normal fixing device is "0". When an envelope fixing device is attached for the first time, the name "envelope fixing device", the sheet size "envelope", and the sheet type "envelope", which were beforehand held in the data storage module 403 as initial values. On the other hand, when a normal fixing device is attached for the first time, the control module 405 adds the printable sheet setting and the name of the fixing device that are input by the operator to the fixing-device management table 600 in association with the ID.

The sheet used for printing can be set by a tray sheet setting of each feed stage through the operation unit 204. Then, the control module 405 is able to check the sheet set to each feed stage.

Figure 7:
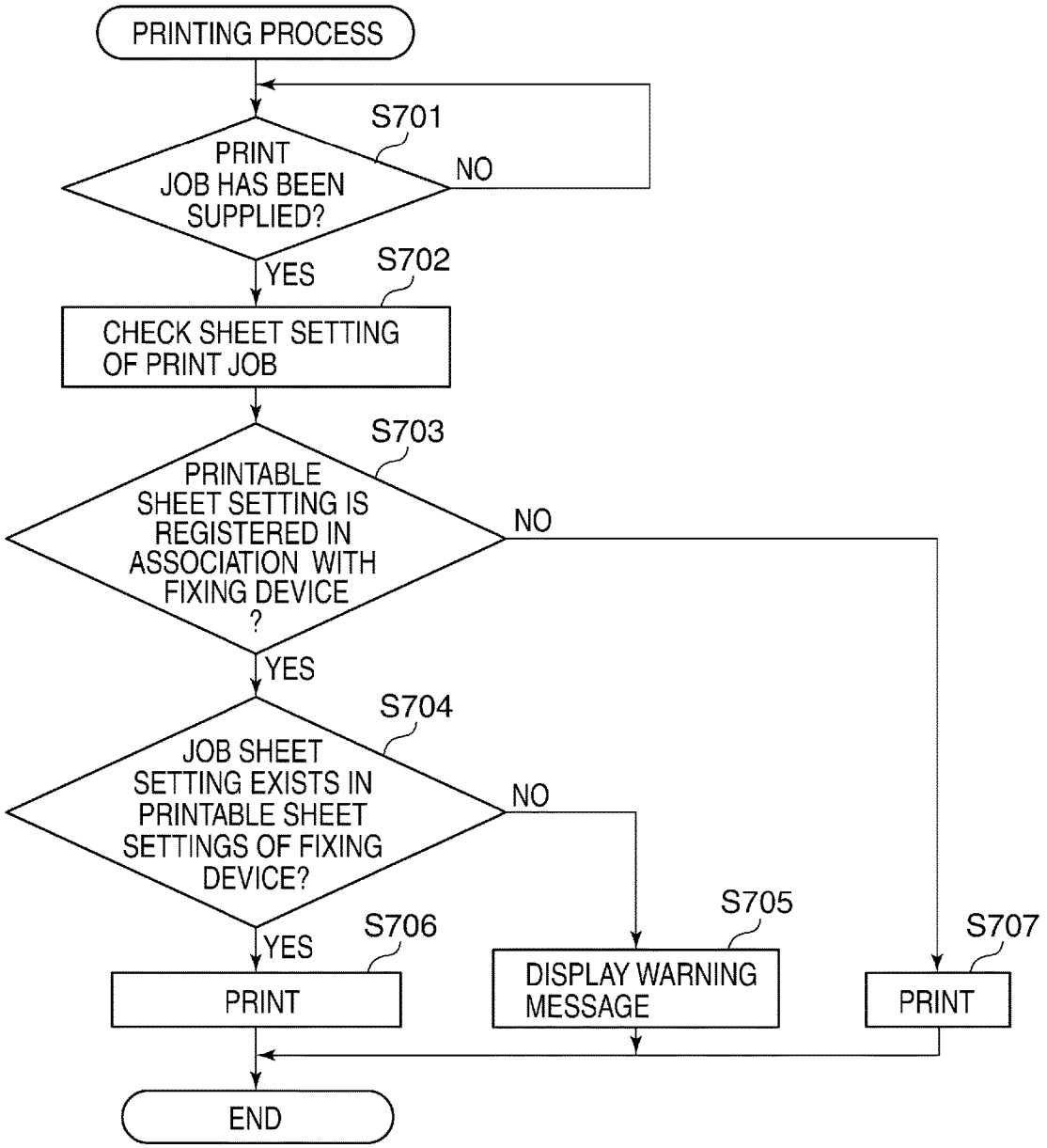
FIG. 7 is a flowchart showing a printing process executed by the image forming apparatus shown in FIG. 1.

FIG. 7 is a flowchart showing a printing process executed by the image forming apparatus 102 shown in FIG. 1.

When the printing process is started, the print job receiving module 401 checks whether a print job has been supplied from the client terminal 101 (step S701). When a print job is not supplied (NO in the step S701), the print job receiving module 401 stands by. When a print job is supplied (YES in the step S701), the print job decompression module 402 checks the sheet setting (job sheet setting) in the print job (step S702). Here, the job sheet setting means a sheet type and a sheet size set in the print job.

Subsequently, the control module 405 searches the fixing-device management table 600 on the basis of the fixing-device identifying signal (ID) that has been obtained from the fixing-device identifying device 217 of the fixing device 213 attached to the image processing apparatus 102 through the printer engine 202, and checks whether the printable sheet setting is registered (designated) in association with the currently attached fixing device (step S703).

When the printable sheet setting is registered in association with the fixing device on the fixing-device management table 600 (YES in the step S703), the control module 405 will check whether the job sheet setting exists in the printable sheet settings of the fixing device concerned (step S704). When the job sheet setting exists in the printable sheet settings of the fixing device (YES in the step S704), the control module 405 supplies sheets corresponding to the job sheet setting from the feed stage and prints (step S706). Then, the control module 405 finishes the printing process.

When the job sheet setting does not exist in the printable sheet settings of the fixing device (NO in the step S704), the control module 405 displays a warning message screen on the operation unit 204 in order to report that the sheet settings of the fixing device differ from the sheet setting of the print job (step S705).

Figure 8:
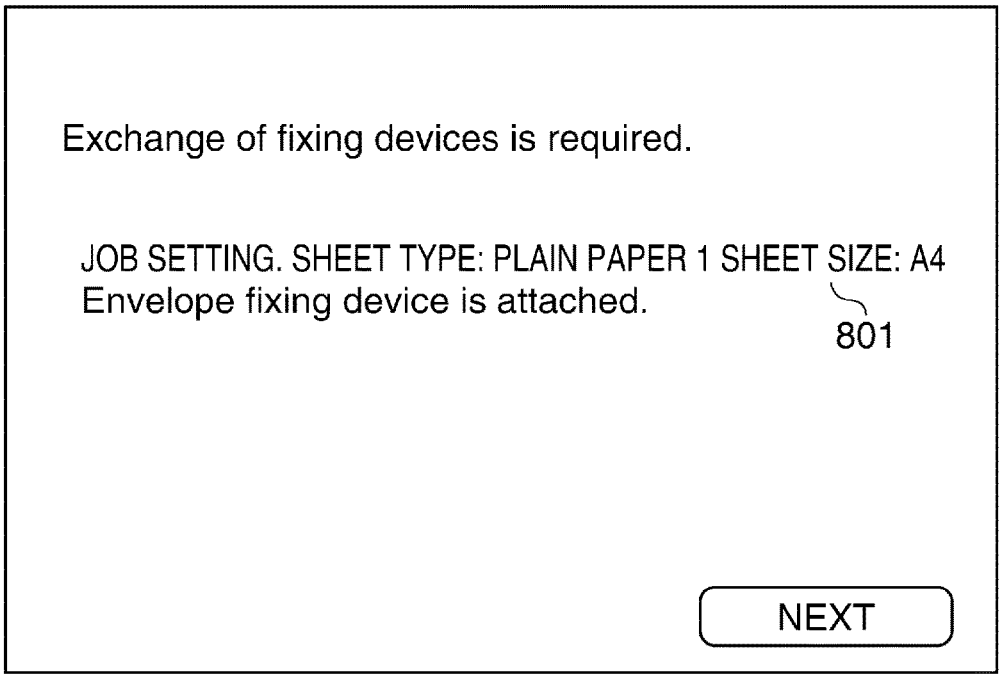
FIG. 8 is a view showing a warning message screen displayed on the operation unit in the step S705 in the printing process shown in FIG. 7.

FIG. 8 is a view showing an example of a warning message screen displayed in the step S705 in FIG. 7.

In the illustrated example, a text "Exchange of fixing devices is required." is displayed as a warning message 801, and the job sheet setting (a sheet type and a sheet size) is displayed. Furthermore, the type of the fixing device (an envelope fixing device in this case) attached to the image forming apparatus 102 is displayed. Accordingly, the warning message 801 informs the operator that the setting of the print job differs from the sheet setting of the currently attached fixing device. Then, when a "NEXT" button in FIG. 8 is pushed, the control module 405 cancels the print job and finishes the printing process.

When no printable sheet setting is registered in association with the fixing device on the fixing-device management table 600 (NO in the step S703), the control module 405 prints according to the print job (step S707). Then, the control module 405 finishes the printing process.

Thus, the first embodiment of the present invention checks the sheet setting set to the print job and the printable sheet settings registered in association with the fixing device, and determines whether the fixing device that is suitable for the type and size of the sheet used is employed. Then, when the job sheet setting is not included in the printable sheet settings of the currently attached fixing device, the warning message is displayed and the print job is canceled. This prevents a situation where a wrinkle occurs in an envelope, a situation where adhesion of the toner becomes imperfect when using a sheet other than an envelope, and occurrence of a print streak, etc.

Next, an image processing apparatus according to a second embodiment of the present invention will be described. It should be noted that the configuration of the image forming apparatus according to the second embodiment is the same as that of the image forming apparatus shown in FIG. 2 and FIG. 4.

In the first embodiment, when the job sheet setting is not included in the printable sheet settings of the currently attached fixing device, the warning message is displayed and the print job is canceled.

On the other hand, some operators want to print regardless of image quality when checking a layout of a print job, for example. Accordingly, the second embodiment inquires of an operator whether printing should be executed, after displaying a warning message.

Figure 9:
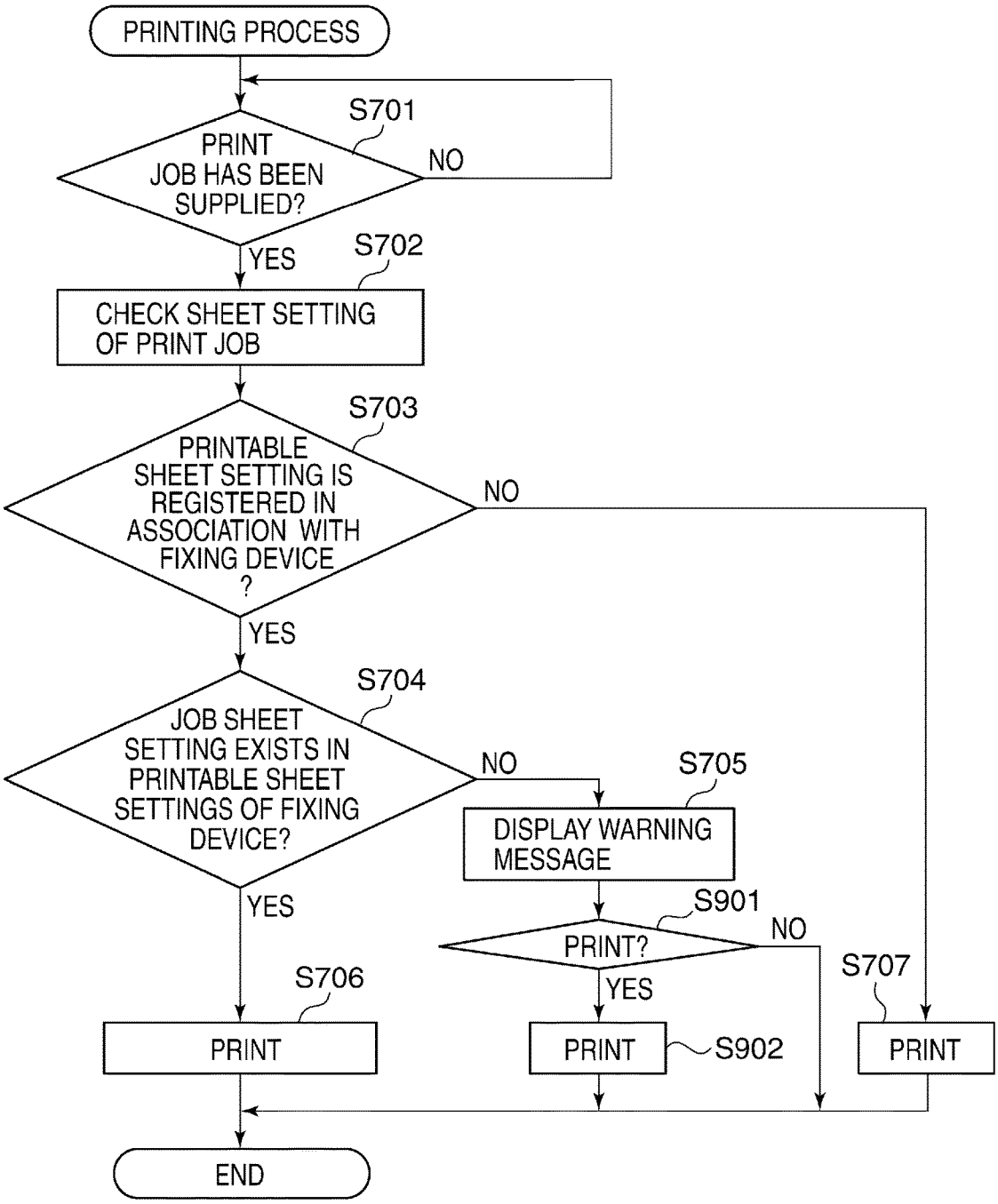
FIG. 9 is a flowchart showing a printing process executed by the image forming apparatus according to a second embodiment of the present invention.

FIG. 9 is a flowchart showing a printing process executed by the image forming apparatus according to the second embodiment of the present invention. It should be noted that steps in the illustrated flowchart that are the same as the steps in the flowchart in FIG. 7 are followed by the same reference numerals, and their descriptions are omitted.

After displaying the warning message in the step S705, the control module 405 inquires of an operator whether printing should be executed (step S901). In this case, when the "NEXT" button shown in FIG. 8 is pushed, the control module 405 displays a print start confirmation screen on the operation unit 204.

Figure 10:
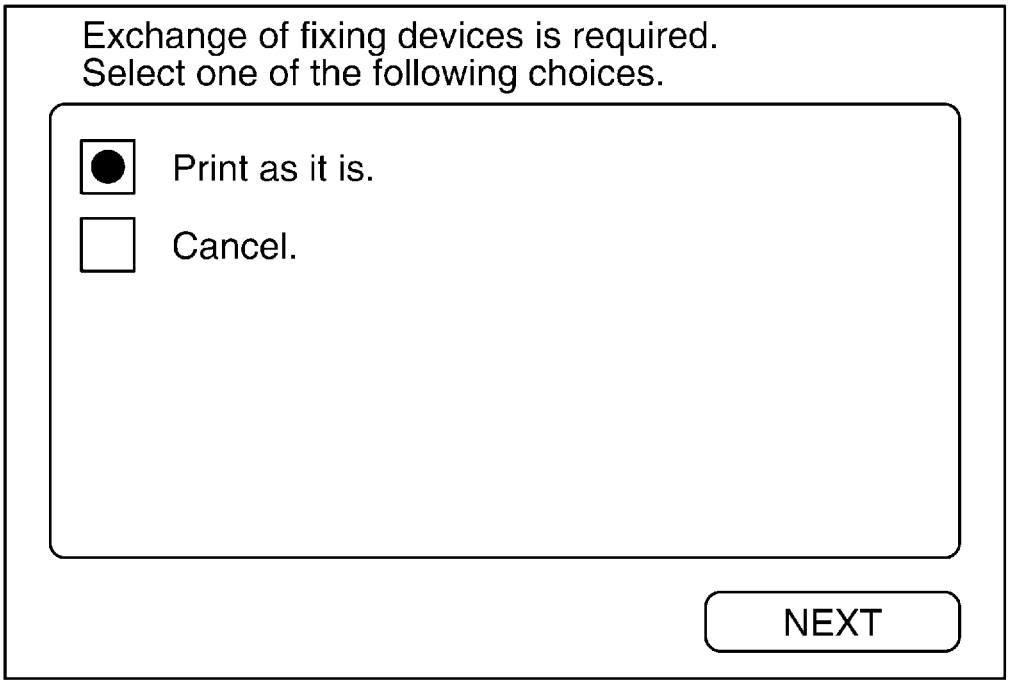
FIG. 10 is a view showing a print start confirmation screen displayed on the operation unit of the image forming apparatus according to the second embodiment of the present invention.

FIG. 10 is a view showing a print start confirmation screen displayed on the operation unit 204 of the image forming apparatus according to the second embodiment of the present invention.

The operator selects "Print as it is." or "Cancel." displayed on the print start confirmation screen (print confirmation message). When "Print as it is." is selected in the print start confirmation screen (YES in the step S901), the control module 405 prints according to the print job (step S902) even if the fixing devices are not exchanged. Then, the control module 405 finishes the printing process. On the other hand, when "Cancel." is selected (NO in the step S901), the control module 405 cancels the print job and finishes the printing process.

Thus, the second embodiment of the present invention allows an operator who wants to continue printing to print according to the print job, even when the sheet setting of the print job is not included in the printable sheet settings of the fixing device.

Next, an image processing apparatus according to a third embodiment of the present invention will be described. It should be noted that the configuration of the image forming apparatus according to the third embodiment is the same as that of the image forming apparatus shown in FIG. 2 and FIG. 4.

In the third embodiment, when printing is executed even when the job sheet setting is not registered as the printable sheet settings of the currently attached fixing device, the job sheet setting can be additionally registered as a printable sheet setting of the fixing device.

FIG. 11 is a flowchart showing a printing process executed by the image forming apparatus according to the third embodiment of the present invention. It should be noted that steps in the illustrated flowchart that are the same as the steps in the flowcharts in FIG. 7 and FIG. 9 are followed by the same reference numerals, and their descriptions are omitted.

After printing in the step S902, the control module 405 determines whether the job sheet setting will be additionally registered as a printable sheet setting of the fixing device currently attached to the image forming apparatus (step S1101). At this time, the control module 405 displays a printable sheet registration screen on the operation unit 204.

Figure 12:
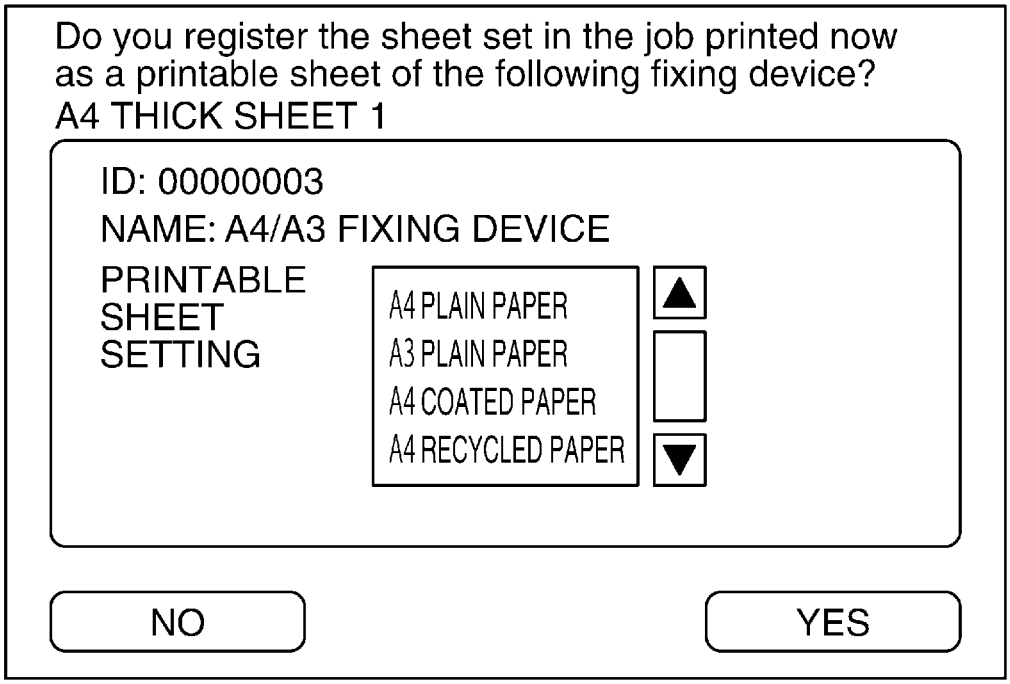
FIG. 12 is a view showing an example of a printable sheet registration screen displayed on an operation unit of the image forming apparatus according to the third embodiment of the present invention.

FIG. 12 is a view showing an example of the printable sheet registration screen displayed on the operation unit 204 of the image forming apparatus according to the third embodiment of the present invention.

In the printable sheet registration screen (registration-confirmed message), the ID, the name, and the printable sheets are displayed, and a text that inquires whether the sheet setting set to the print job will be registered is displayed.

When a "YES" button is selected in the printable sheet registration screen (YES in the step S1101), the control module 405 searches the fixing-device management table 600 on the basis of the ID, and registers the job sheet setting as the printable sheet setting in association with the fixing device concerned (step S1012). Then, the control module 405 finishes the printing process. On the other hand, when a "NO" button is selected in the printable sheet registration screen (NO in the step S1101), the control module 405 finishes the printing process without registering the job sheet setting.

Thus, in the third embodiment of the present invention, after the operator who wants to continue printing prints according to the print job, the sheet set in the print job can be registered in association with the fixing device used by printing.

Next, an image processing apparatus according to a fourth embodiment of the present invention will be described. It should be noted that the configuration of the image forming apparatus according to the third embodiment is the same as that of the image forming apparatus shown in FIG. 2 and FIG. 4.

In the above-mentioned first embodiment, the control module 405 cancels a print job, after displaying a warning message. In this case, in order to execute the print job, the operator needs to supply the print job again. Accordingly, the fourth embodiment enables a print job to be saved when a warning message screen is displayed, which saves operator's trouble for supplying a print job again.

Figure 13:
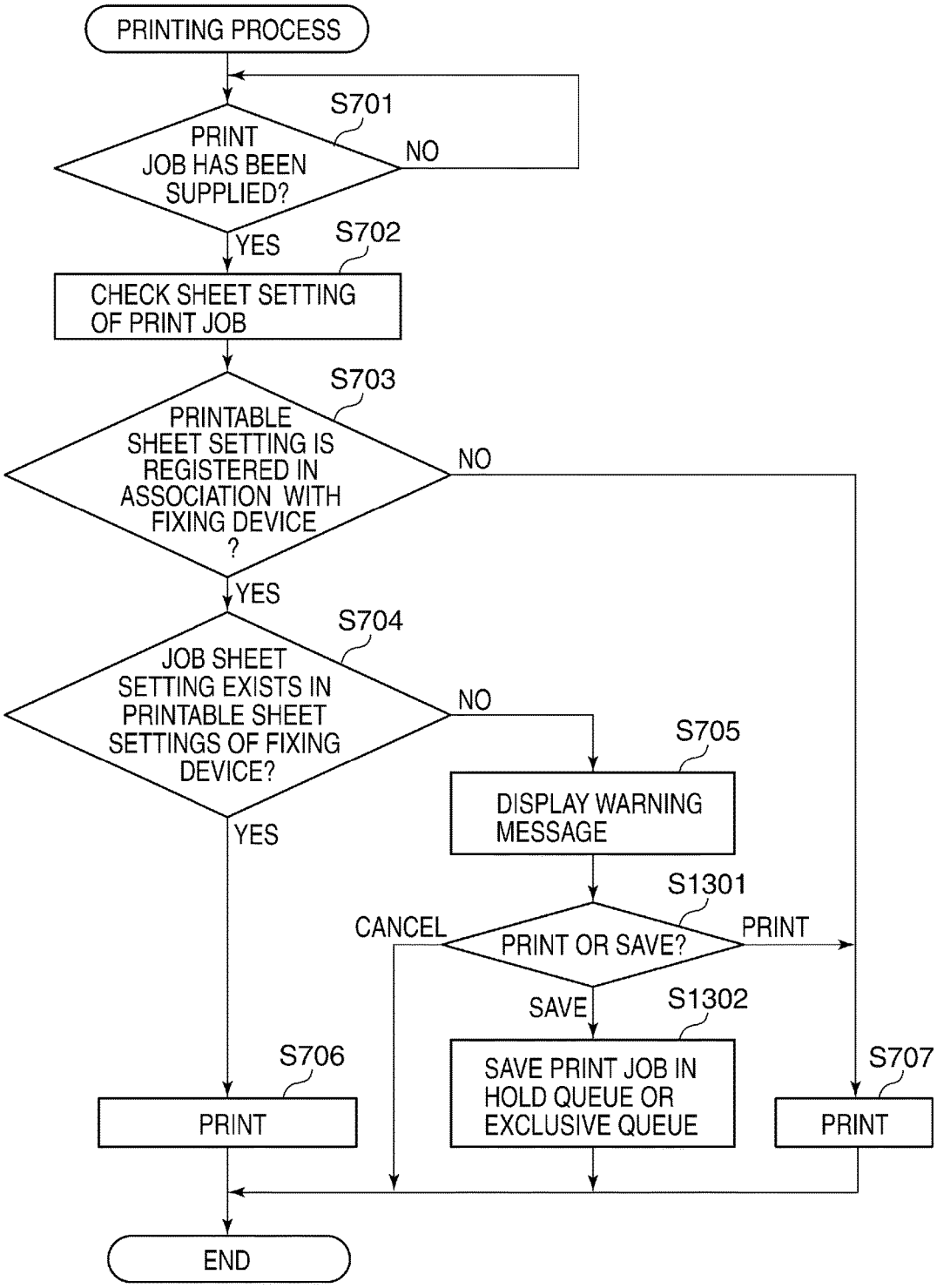
FIG. 13 is a flowchart showing a printing process executed by an image forming apparatus according to a fourth embodiment of the present invention.

FIG. 13 is a flowchart showing a printing process executed by the image forming apparatus according to the fourth embodiment of the present invention. It should be noted that steps in the illustrated flowchart that are the same as the steps in the flowchart in FIG. 7 are followed by the same reference numerals, and their descriptions are omitted.

After displaying the warning message screen on the operation unit 204 in the step S705, the control module 405 inquires of an operator whether the print job should be printed or saved (step S1301). In this case, when the "NEXT" button shown in FIG. 8 is pushed, the control module 405 displays a print/save confirmation screen on the operation unit 204.

Figure 14:
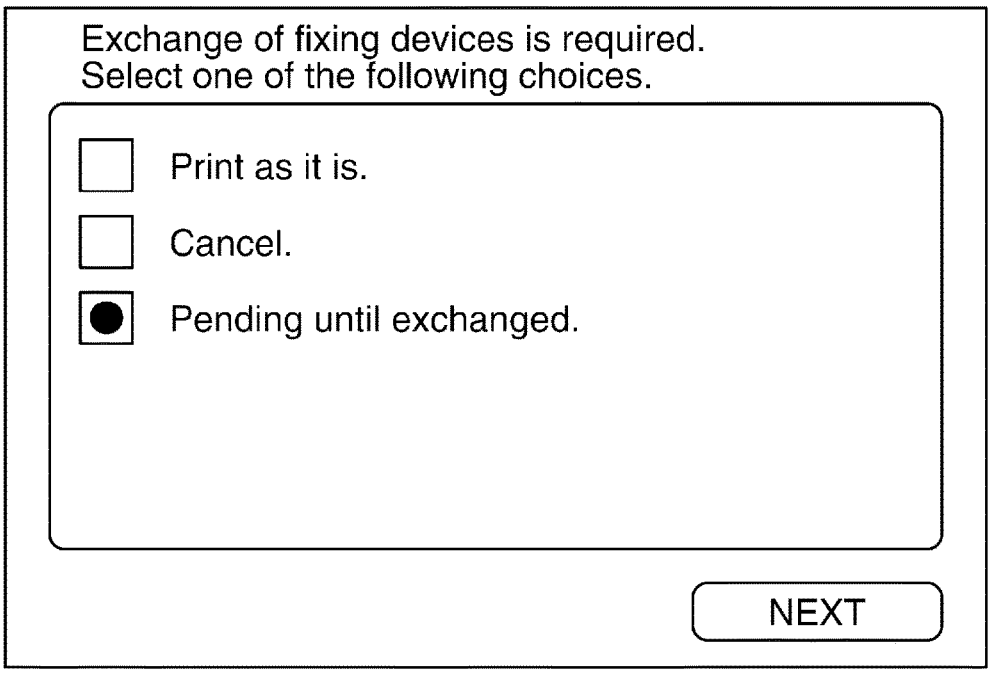
FIG. 14 is a view showing a print/save confirmation screen displayed on an operation unit of the image forming apparatus according to the fourth embodiment of the present invention.

FIG. 14 is a view showing the print/save confirmation screen displayed on the operation unit 204 of the image forming apparatus according to the fourth embodiment of the present invention.

In the print/save confirmation screen (preservation message), "Print as it is.", "Cancel.", and "Pending until exchanged." are displayed. The operator determines whether the print job should be printed or saved in view of the print/save confirmation screen concerned. When "Print as it is." is selected in the print/save confirmation screen (Print in the step S1301), the control module 405 prints in the step S707, and finishes the printing process.

When "Cancel." is selected (Cancel in the step S1301), the control module 405 cancels the print job and finishes the printing process. On the other hand, when "Pending until exchanged." is selected (Save in the step S1301), the control module 405 saves the print job concerned in a hold queue (step S1302). Then, the control module 405 finishes the printing process.

In this example, the print job is saved in the hold queue. However, a print job may be saved in an exclusive queue so that the printing will be automatically started after exchanging the fixing units without supplying the print job again.

Thus, in the fourth embodiment of the present invention, since the print job can be saved after displaying the warning message, the time which supplies a print job again can be saved.

Next, an image processing apparatus according to a fifth embodiment of the present invention will be described. It should be noted that the configuration of the image forming apparatus according to the fifth embodiment is the same as that of the image forming apparatus shown in FIG. 2 and FIG. 4.

The operator may exchange the fixing devices after the warning message screen is displayed in the above-mentioned first embodiment. However, when a temperature of the fixing device is extremely high, the operator cannot detach the fixing device until the temperature falls to a predetermined temperature. Accordingly, the fifth embodiment displays a time until the exchange of the fixing devices becomes possible after displaying the warning message screen so as to enable the operator to select whether printing should be continued.

Figure 15:
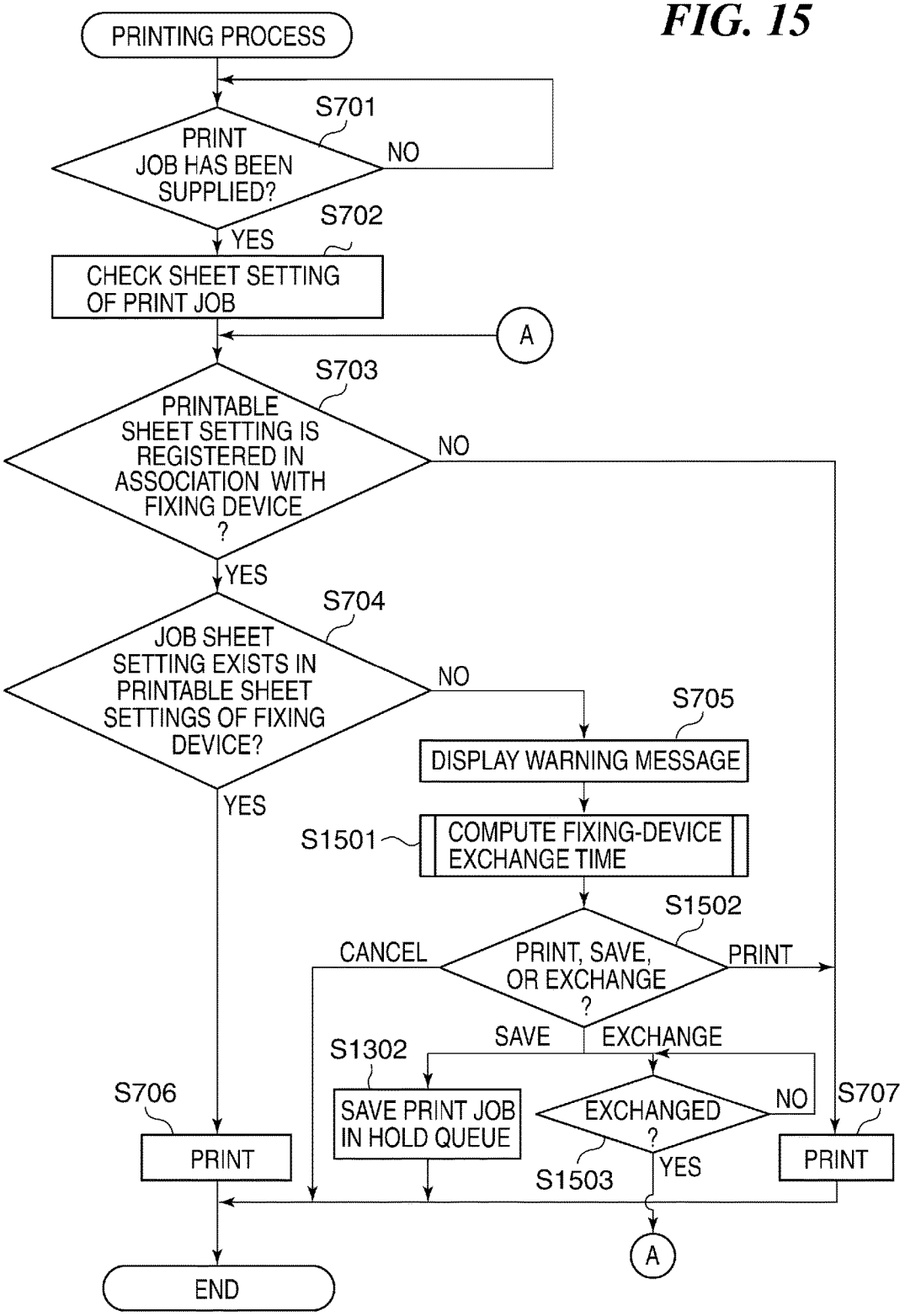
FIG. 15 is a flowchart showing a printing process executed by an image forming apparatus according to a fifth embodiment of the present invention.

FIG. 15 is a flowchart showing a printing process executed by the image forming apparatus according to the fifth embodiment of the present invention. It should be noted that steps in the illustrated flowchart that are the same as the steps in the flowchart in FIG. 7 are followed by the same reference numerals, and their descriptions are omitted.

When the "NEXT" button shown in FIG. 8 is pushed after displaying the warning message screen on the operation unit 204 in the step S705, the control module 405 computes an exchange time that is a time until exchange of the fixing devices becomes possible (step S1501).

Figure 16:
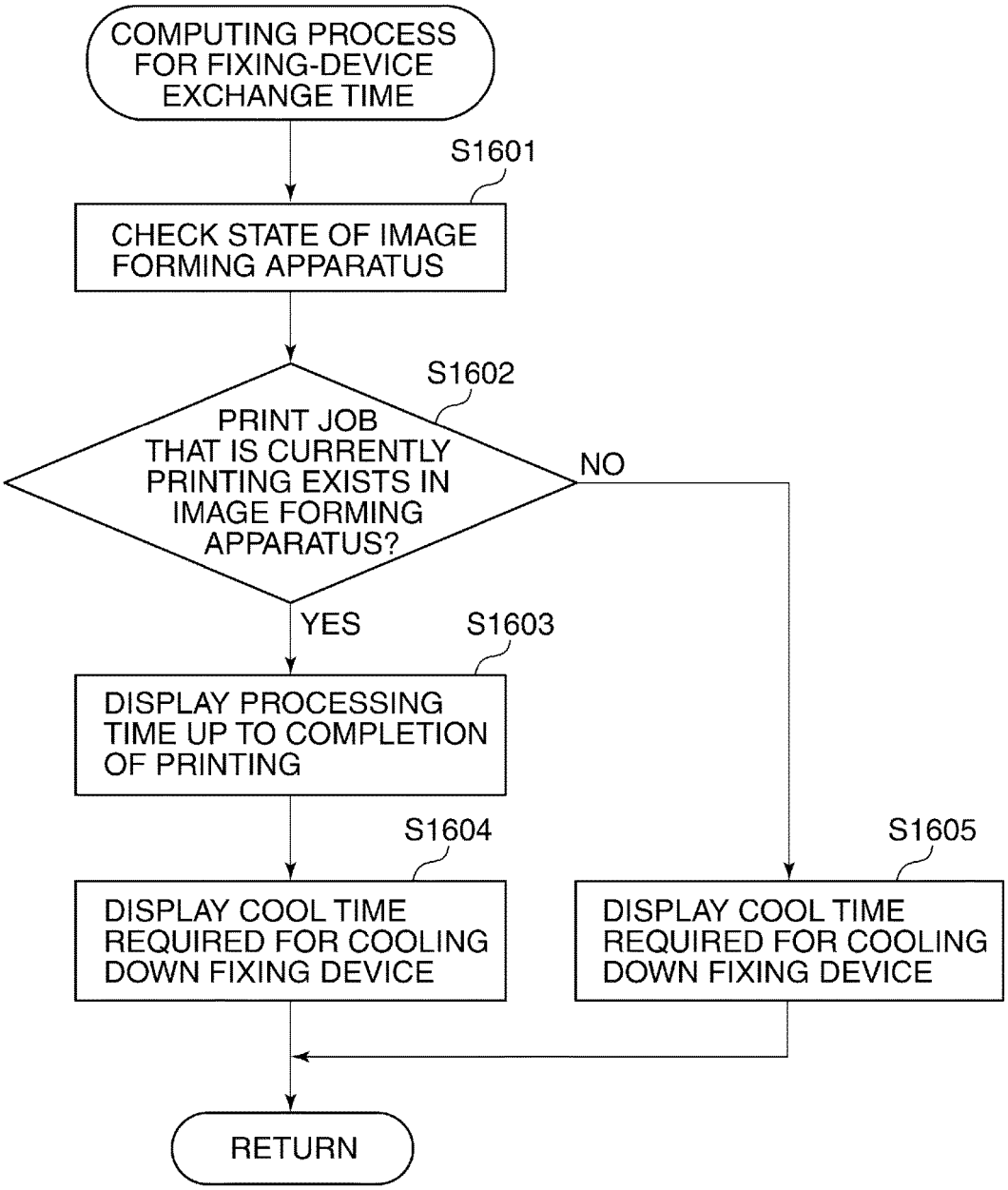
FIG. 16 is a flowchart showing a computing process for the fixing-device exchange time executed in the step S1501 in the printing process shown in FIG. 15.

FIG. 16 is a flowchart showing a computing process for the fixing-device exchange time executed in the step S1501 in the printing process shown in FIG. 15.

When the computing process for the fixing-device exchange time is started, the control module 405 checks the state of the image forming apparatus 102 (step S1601).

It should be noted that the states of the image forming apparatus 102 include an in-printing state, an idling state, and a power saving state. The image forming apparatus 102 heats the fixing device to a temperature required for fixing in the in-printing state and the idling state so as to enable to print. On the other hand, when the image forming apparatus 102 is in the power saving state (or immediately after returning from the power saving state), the temperature of the fixing device 213 is low because electric current is not supplied to the fixing device 213.

Subsequently, the control module 405 checks whether a print job that is currently printing exists in the image forming apparatus 102 on the basis of the state checked in the step S1601 (step S1602). When the print job in printing exists (YES in the step S1602), the control module 405 computes a processing time up to completion of the printing, and display it on the operation unit 204 (step S1603). Then, the control module 405 computes a cool time required for cooling down the fixing device to a predetermined temperature, and displays it on the operation unit 204 (step S1604). Then, the control unit 405 returns the process to the step S1502 shown in FIG. 15.

On the other hand, when there is no print job in printing (NO in the step S1602), the control module 405 computes the cool time required for cooling down the fixing device, and displays it on the operation unit 204 (step S1605). If the image forming apparatus 102 is in the idling state, a predetermined cool time is needed. On the other hand, when the image forming apparatus 102 is in the power saving state and the temperature of the fixing device is low, the cool time is not needed. Then, the control unit 405 returns the process to the step S1502 shown in FIG. 15.

Referring to FIG. 15 again, the control module 405 displays a fixing-device exchange screen for checking whether the fixing devices should be exchanged on the operation unit 204, and makes the operator select a future process (step S1502).

Figure 17:
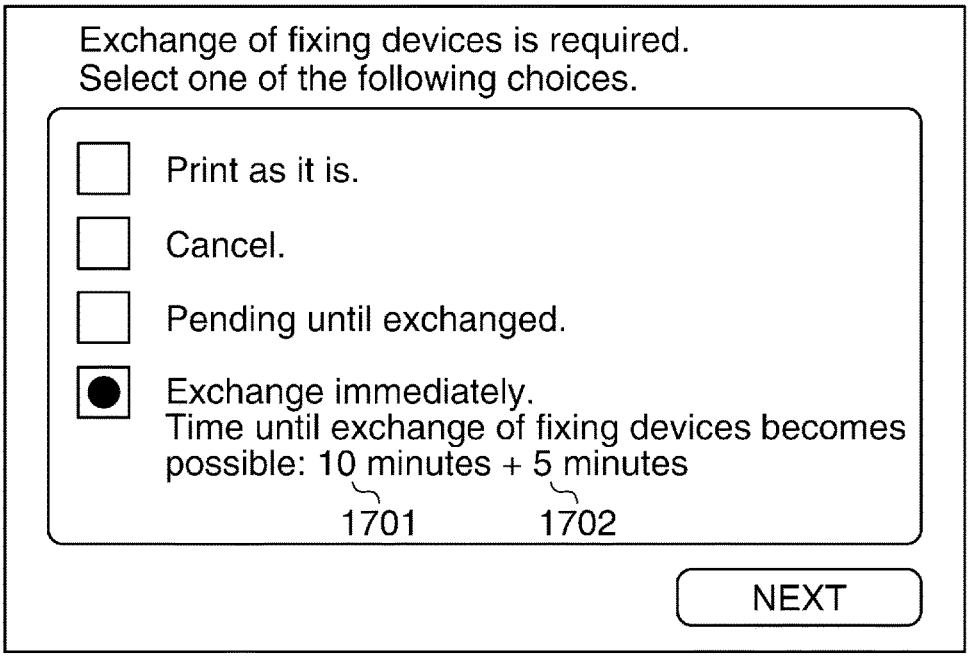
FIG. 17 is a view showing a fixing-device exchange screen displayed on the operation unit of the image forming apparatus according to the fifth embodiment of the present invention.

FIG. 17 is a view showing the fixing-device exchange screen displayed on the operation unit 204 of the image forming apparatus according to the fifth embodiment of the present invention.

In the fixing-device exchange screen (exchange message), "Print as it is.", "Cancel.", "Pending until exchanged.", and "Exchange immediately." are displayed. Moreover, the processing time 1701 and the cool time 1702 are displayed in association with "Exchanging immediately." In this example, the processing time 1701 is 10 minutes and the cool time is 5 minutes. The operator determines whether the fixing devices should be exchanged with reference to the processing time 1701 and the cool time 1702 that are displayed on this screen. When "Print as it is." is selected in the fixing-device exchange screen (Print in the step S1502), the control module 405 prints in the step S707, and finishes the printing process.

When "Cancel." is selected (Cancel in the step S1502), the control module 405 cancels the print job and finishes the printing process. On the other hand, when "Pending until exchanged." is selected (Save in the step S1502), the control module 405 saves the print job concerned in a hold queue (step S1302). Then, the control module 405 finishes the printing process.

When "Exchange immediately." is selected (Exchange in the step S1502), the control module 405 displays a message indicating that the exchange will be possible after elapsing the total time of the processing time 1701 and the cool time 1702 on the operation unit 204, and stands by until the fixing devices are exchanged (step S1503). Then, when the fixing devices are exchanged (YES in the step S1503), the control module 405 returns the process to the step S703.

Thus, the fifth embodiment of the present invention displays the time until exchange of the fixing devices becomes possible, which enables the operator to easily select whether the printing should be continued.

Next, an image processing apparatus according to a sixth embodiment of the present invention will be described. It should be noted that the configuration of the image forming apparatus according to the sixth embodiment is the same as that of the image forming apparatus shown in FIG. 2 and FIG. 4.

In the first embodiment, the case where one print job is supplied from the client terminal 101 is described. However, a plurality of print jobs may be supplied actually. In this case, even if the job sheet setting of the first print job is not included in the printable sheet settings of the fixing device, the job sheet setting of the following print job may be included in the printable sheet settings of the fixing device. In such a case, an operator cannot check that the print job that can be printed using the currently attached fixing device exists, according to the first embodiment.

In the sixth embodiment, when the job sheet setting of the following print job exists in the printable sheet settings of the fixing device, an operator checks whether the following print job will be printed first at the time when a warning message is displayed.

Figure 18A:
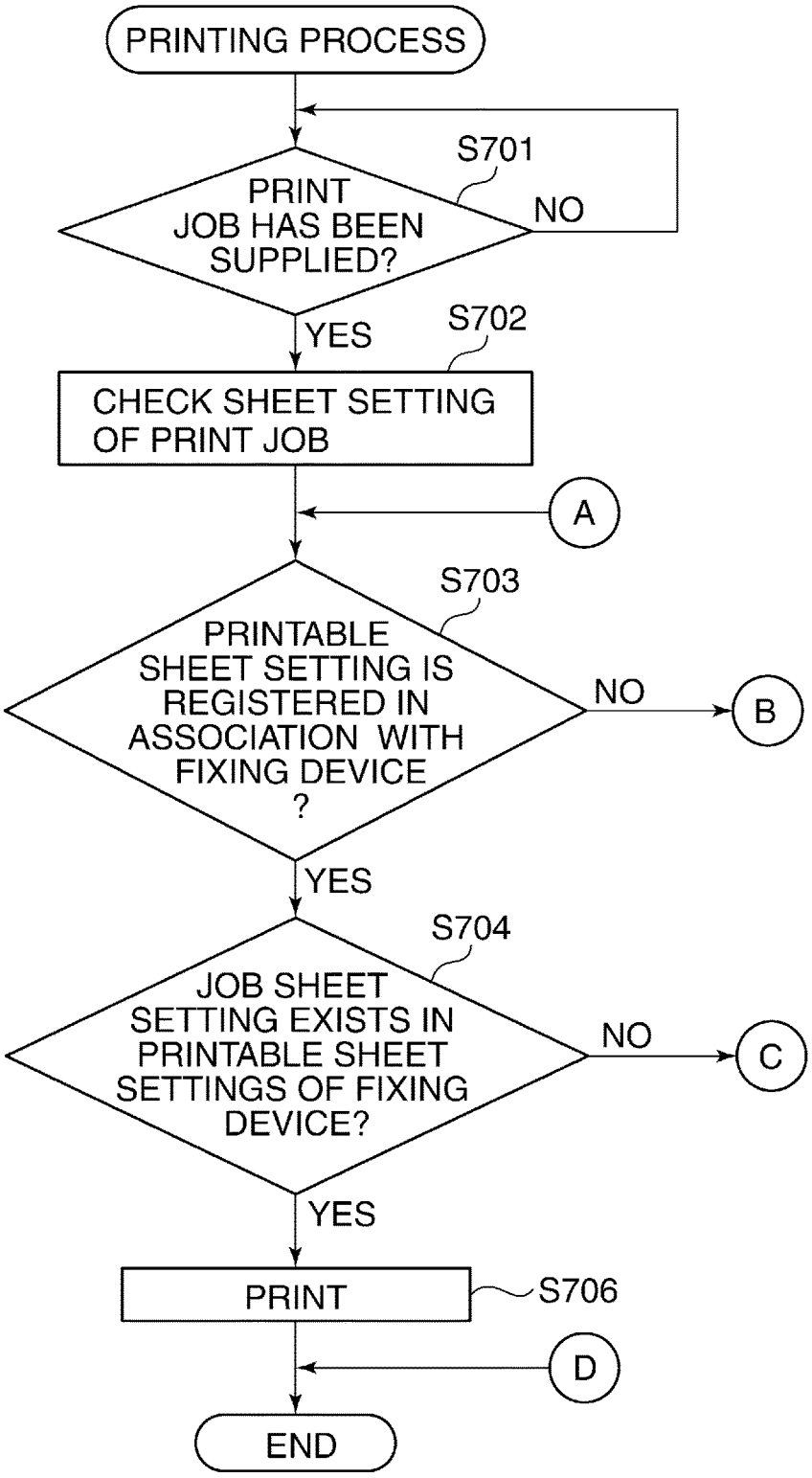
FIG. 18A and FIG. 18B are flowcharts showing a printing process executed by an image forming apparatus according to a sixth embodiment of the present invention.
Figure 18B:
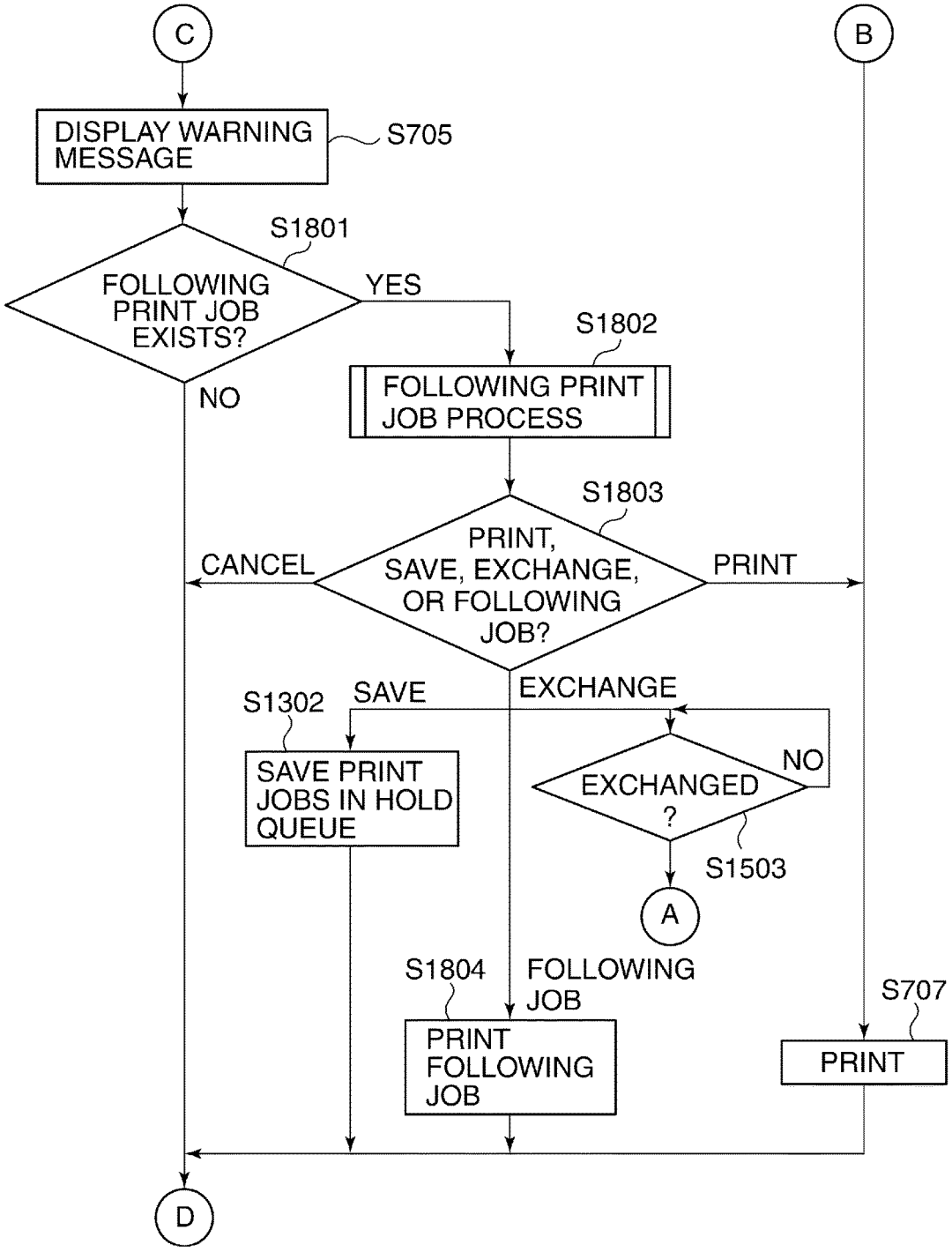

FIG. 18A and FIG. 18B are flowcharts showing a printing process executed by an image forming apparatus according to the sixth embodiment of the present invention. It should be noted that steps in the illustrated flowchart that are the same as the steps in the flowchart in FIG. 7 are followed by the same reference numerals, and their descriptions are omitted.

When the "NEXT" button shown in FIG. 8 is pushed after displaying the warning message screen on the operation unit 204 in the step S705, the control module 405 checks whether the following print job (i.e., an unprocessed print job) exists (step S1801). When the following print job does not exist (NO in the step S1801), the control module 405 cancels the current print job and finishes the printing process. On the other hand, when the following print job exists (YES in the step S1801), the control module 405 performs a following print job process (step S1802).

Figure 19:
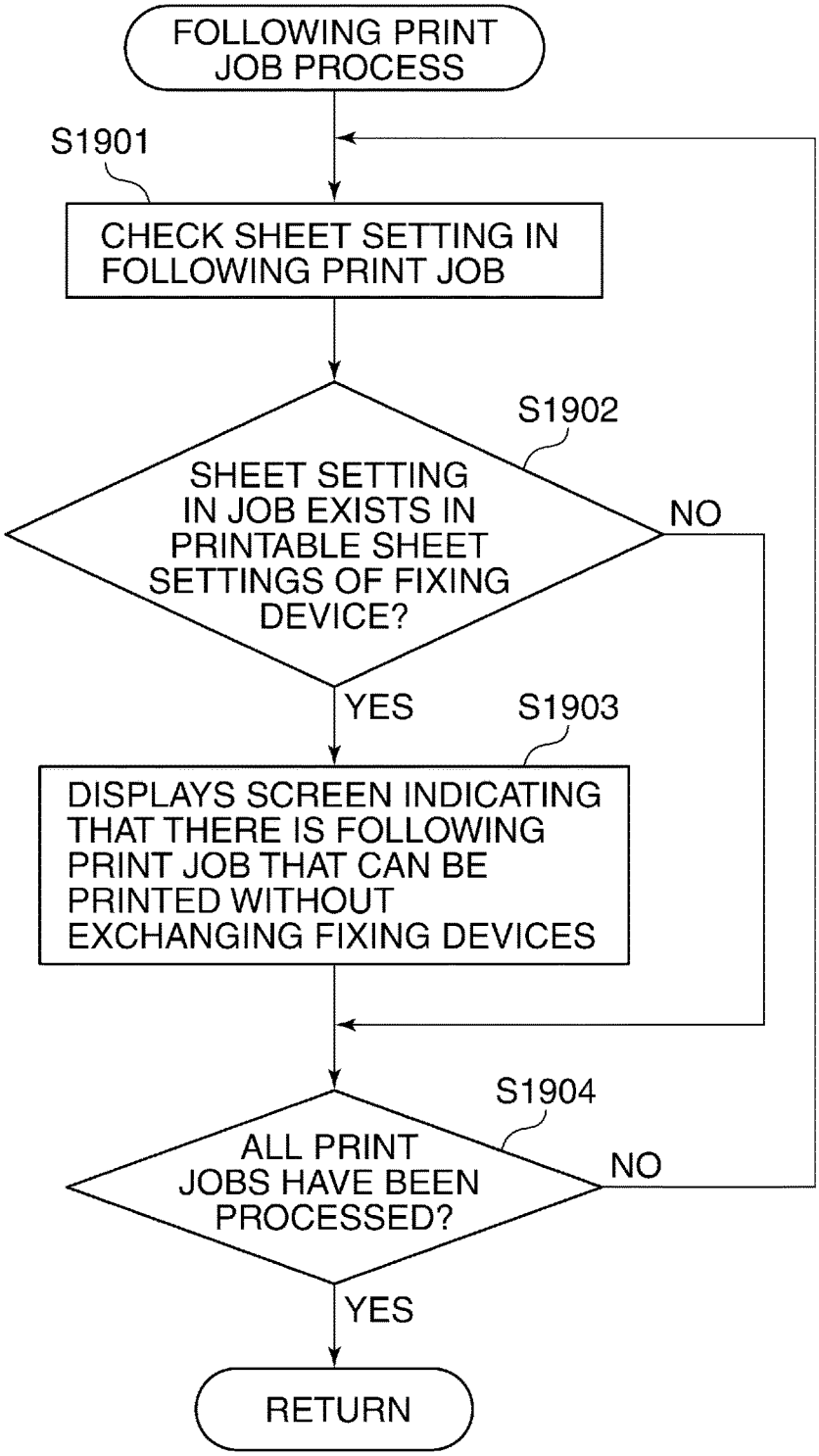
FIG. 19 is a flowchart showing a following print job process executed in the step S1802 in the printing process shown in FIG. 18B.

FIG. 19 is a flowchart showing the following print job process executed in the step S1802 in the printing process shown in FIG. 18B.

When the following print job process is started, the print job decompression module 402 checks the sheet setting in the following print job (step S1901). Subsequently, the control module 405 searches the fixing-device management table 600 on the basis of the fixing-device identifying signal obtained from the printer engine 202 to check whether the job sheet setting of the following print job exists in the printable sheet settings of the currently attached fixing device (step S1902).

When the job sheet setting exists in the printable sheet settings of the fixing device (YES in the step S1902), the control module 405 displays a printable job screen indicating that there is the following print job that can be printed without exchanging fixing devices on the operation unit 204 (step S1903).

Subsequently, the control module 405 checks whether all the following print jobs have been processed (step S1904). When not all the print jobs are processed (NO in the step S1904), the control module 405 returns the process to the step S1901, and processes the following print job. On the other hand, when all the print jobs have been processed (YES in the step S1904), the control module 405 proceeds with the process to step S1803 in FIG. 18B.

In the step S1803, the control module 405 selects a future process according to an operation of the operator on the printable job screen displayed on the operation unit 204.

Figure 20:
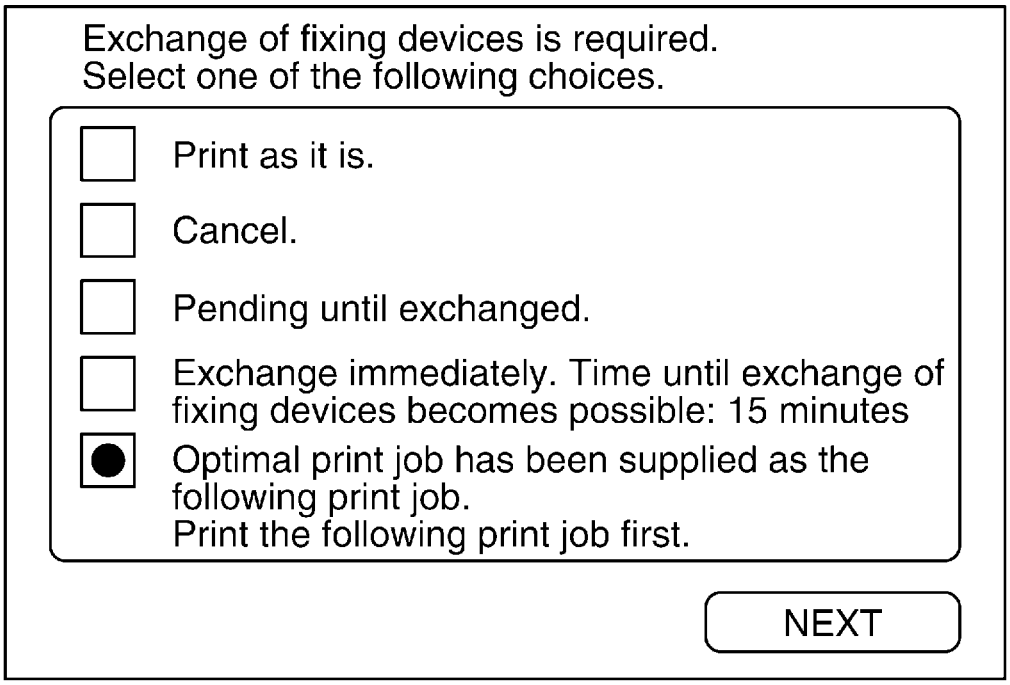
FIG. 20 is a view showing a printable job screen displayed on an operation unit of the image forming apparatus according to the sixth embodiment of the present invention.

FIG. 20 is a view showing an example of the printable job screen displayed on the operation unit 204 of the image forming apparatus according to the sixth embodiment of the present invention.

In the printable job screen (execution confirmation message), "Print as it is.", "Cancel.", "Pending until exchanged.", "Exchange immediately.", and "Optimal print job has been supplied as the following print job. Print the following print job first." are displayed. Moreover, the time until exchange of the fixing devices becomes possible is computed according to the similar process to the fifth embodiment, and is displayed in association with the "Exchange immediately." When "Print as it is." is selected in the printable job screen (Print in the step S1803), the control module 405 prints according to the first print job in the step S707.

When "Cancel." is selected (Cancel in the step S1803), the control module 405 cancels the print job and finishes the printing process. On the other hand, when "Pending until exchanged." is selected (Save in the step S1803), the control module 405 saves the first print job and the following print jobs in the hold queue (step S1302). Then, the control module 405 finishes the printing process.

When "Exchange immediately." is selected (Exchange in the step S1803), the control module 405 displays the message indicating that the exchange will be possible after elapsing the total time of the printing completion time 1701 and the cool time 1702 on the operation unit 204 as with in the fifth embodiment, and stands by until fixing devices are exchanged (step S1503). Then, when the fixing devices are exchanged (YES in the step S1503), the control module 405 returns the process to the step S703. Moreover, when "Optimal print job has been supplied as the following print job. Print the following print job first." is selected (Following job in the step S1803), the control module 405 prints according to the following print job concerned (step S1804). Then, the control module 405 finishes the printing process.

Thus, the sixth embodiment of the present invention allows the operator to print according to the following print job first, when the following print job exists and the sheet setting of the following print job exists in the printable sheet settings of the fixing device.

As shown by the above description, the memory 208 functions as the storage unit, and the CPU 205 functions as the notifying unit and the control unit in the example shown in FIG. 2.

Although the embodiments of the present invention have been described, the present invention is not limited to the above-mentioned embodiments, the present invention includes various modifications as long as the concept of the invention is not deviated.

For example, the functions of the above mentioned embodiments may be achieved as a control method that is executed by an image forming apparatus. Moreover, the functions of the above mentioned embodiments may be achieved as a control program that is executed by a computer with which the image forming apparatus is provided. It should be noted that the control program is recorded into a computer-readable storage medium, for example.

Each of the above-mentioned control method and control program has a storing step, an executing step, and a determining step at least.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-152913, filed Jul. 28, 2014, which is hereby incorporated by reference herein in its entirety.

What is claimed is:

1. An image forming apparatus comprises:

an image forming device configured to form a toner image on a sheet during printing which corresponds to an input print job;

a fixing device configured to fix the toner image formed on the sheet by the image forming device, the fixing device being exchangeable with another fixing device;

a storage unit configured to store information which corresponds to a sheet size which is permitted for a fixing process to be executed by the fixing device;

a controller configured to acquire, from the storage unit, the information which corresponds to a sheet size which is permitted for a fixing process to be executed by a currently-attached fixing device; and a selection unit configured to urge an operator to select one mode from among a plurality of modes including a first mode and a second mode, wherein in a case where a first print job requiring a sheet to be used, of which the sheet size does not coincide with the sheet size presented by the information acquired by the controller, and a second print job requiring a sheet to be used, of which the sheet size coincides with the sheet size presented by the information acquired by the controller, are input continuously and consequently, in the first mode, the first print job is executed prior to the second print job, and in the second mode, the second print job is executed prior to the first print job, and wherein the controller executes the one mode selected by the operator through the selection unit.

2. The image forming apparatus according to claim 1, wherein the selection unit has a display device, and the controller displays options including the first mode and the second mode on the display device.

3. The image forming apparatus according to claim 2, wherein the controller displays the options on the display device according to the continuous and consequent input of the first print job and the second print job.

4. The image forming apparatus according to claim 1, wherein in a case where a first print job requiring a sheet to be used, of which the sheet size does not coincide with the sheet size presented by the information acquired by the controller, and a second print job requiring a sheet to be used, of which the sheet size coincides with the sheet size presented by the information acquired by the controller, are input continuously and consequently, in the first mode, the controller executes the first print job after standing by until a fixing device which is permitted to use a sheet having a size for the first print job is attached.

5. An image forming apparatus comprises:

an image forming device configured to form a toner image on a sheet during printing which corresponds to an input print job;

a first fixing device configured to fix the toner image formed on the sheet by the image forming device, the first fixing device being permitted to execute a fixing process on the sheet of a predetermined type including a predetermined envelope, wherein the first fixing device is exchangeable with a second fixing device configured to fix the toner image formed on the sheet by the image forming device and is permitted to execute the fixing process on the sheet of a predetermined type not including the predetermined envelope;

a selection unit configured to urge an operator to select one mode from among a plurality of modes including a first mode and a second mode, wherein in a case where: the first fixing device is currently attached on the image forming apparatus and the second fixing device is not currently attached on the image forming apparatus; and a first print job requiring the second fixing device to be used and a second print job requiring the first fixing device to be used are input continuously and consequently, in the first mode, the first print job is executed prior to the second print job, and in the second mode, the second print job is executed prior to the first print job; and a controller configured to execute the one mode selected by the operator through the selection unit.

6. The image forming apparatus according to claim 5, wherein the selection unit has a display device, and the controller displays options including the first mode and the second mode on the display device.

7. The image forming apparatus according to claim 6, wherein the controller displays the options on the display device according to the continuous and consequent input of the first print job and the second print job.

8. The image forming apparatus according to claim 5, wherein in a case where: the first fixing device is currently attached on the image forming apparatus and the second fixing device is not currently attached on the image forming apparatus; and a first print job requiring the second fixing device to be used and a second print job requiring the first fixing device to be used are input continuously and consequently, in the first mode, the controller executes the first print job after standing by until the second fixing device is attached.

9. An image forming apparatus comprises:

an image forming device configured to form a toner image on a sheet during printing which corresponds to an input print job;

a fixing device configured to fix the toner image formed on the sheet by the image forming device, the fixing device comprising a identifying device which presents a first information for identifying the fixing device from another fixing device which is exchangeable with the fixing device;

a storage unit configured to store a second information in association with the first information, the second information corresponding to a sheet attribute which is permitted for a fixing process to be executed by the fixing device comprising the identifying device which presents the first information;

a controller configured to acquire, from the storage unit, the second information corresponded to the first information presented by an identifying device of a currently-attached fixing device; and a selection unit configured to urge an operator to select one mode from among a plurality of modes including a first mode and a second mode, wherein in a case where a first print job requiring a sheet to be used, of which the sheet attribute does not coincide with the sheet attribute presented by the second information acquired by the controller, and a second print job requiring a sheet to be used, of which the sheet attribute coincides with the sheet attribute presented by the second information acquired by the controller, are input continuously and consequently, in the first mode, the first print job is executed prior to the second print job, and in the second mode, the second print job is executed prior to the first print job, and wherein the controller executes the one mode selected by the operator through the selection unit.

10. An image forming apparatus comprises:

a receiving unit configured to receive a print job;

an image forming device configured to form, on a sheet, a toner image to execute the print job received by the receiving unit;

a fixing device configured to fix the toner image formed on the sheet by the image forming device, the fixing device being exchangeable with another fixing device;

a storage unit configured to store information which corresponds to a sheet size which is permitted for a fixing process to be executed by the fixing device; and a controller configured to acquire, from the storage unit, the information which corresponds to a sheet size which is permitted for a fixing process to be executed by a currently-attached fixing device, wherein at least in response to a first print job and a second print job being continuously received in this order by the receiving unit, the first print job being for forming a toner image on a sheet having a sheet size that does not coincide with the sheet size presented by the information acquired by the controller, and the second print job being for forming a toner image on a sheet having a sheet size that coincides with the sheet size presented by the information acquired by the controller, the controller urges an operator to select whether or not to execute the second print job prior to the first print job.

11. The image forming apparatus according to claim 10, wherein the controller displays options whether or not to execute the second print job prior to the first print job on a display device.

12. The image forming apparatus according to claim 11, wherein the image forming apparatus comprises the display device.

13. The image forming apparatus according to claim 10, wherein in a case where the controller receives an instruction which indicates that the second print job should not be executed prior to the first print job, the controller executes the first print job prior to the second print job after a fixing device, which is permitted to use a sheet having a sheet size that coincides with the sheet size of the sheet used for the first print job, is attached, and wherein in a case where the controller receives an instruction which indicates that the second print job should be executed prior to the first print job, the controller executes the second print job prior to the first print job without exchange of fixing devices.

14. An image forming apparatus comprises:

a receiving unit configured to receive a print job;

an image forming device configured to form, on a sheet, a toner image to execute the print job received by the receiving unit;

a fixing device configured to fix the toner image formed on the sheet by the image forming device, the fixing device being exchangeable with another fixing device;

a storage unit configured to store information on a plurality of sheet sizes permitted for a fixing process to be executed by the fixing device; and a controller configured to acquire, from the storage unit, the information on the plurality of sheet sizes permitted for a fixing process to be executed by a currently-attached fixing device, wherein at least in response to a first print job and a second print job being continuously received in this order by the receiving unit, the first print job for forming a toner image on a sheet having a sheet size that is not included in the plurality of sheet sizes presented by the information acquired by the controller, and the second print job being for forming a toner image on a sheet having a sheet size that is included in the plurality of sheet sizes presented by the information acquired by the controller, the controller urges an operator to select whether or not to execute the second print job prior to the first print job.

15. The image forming apparatus according to claim 14, wherein the controller displays options whether or not to execute the second print job prior to the first print job on a display device.

16. The image forming apparatus according to claim 15, wherein the image forming apparatus comprises the display device.

17. The image forming apparatus according to claim 14, wherein in a case where the controller receives an instruction which indicates that the second print job should not be executed prior to the first print job, the controller executes the first print job prior to the second print job after a fixing device, which is permitted to use a sheet having a sheet size that coincides with the sheet size of the sheet used for the first print job, is attached, and wherein in a case where the controller receives an instruction which indicates that the second print job should be executed prior to the first print job, the controller executes the second print job prior to the first print job without exchange of fixing devices.

18. An image forming apparatus comprises:

a receiving unit configured to receive a print job;

an image forming device configured to form, on a sheet, a toner image to execute the print job received by the receiving unit;

a first fixing device configured to fix the toner image formed on the sheet by the image forming device, the first fixing device being permitted to execute a fixing process on the sheet of a predetermined type not including a predetermined envelope, wherein the first fixing device is exchangeable with a second fixing device configured to fix the toner image formed on the sheet by the image forming device and is permitted to execute a fixing process on the sheet of a predetermined type including the predetermined envelope; and a controller configured to, at least in response to a first print job to be executed by using the second fixing device, which is not currently attached on the image forming apparatus, and a second print job to be executed by using the first fixing device, which is currently attached on the image forming apparatus, being received continuously in this order by the receiving unit, urge an operator to select whether or not to execute the second print job prior to the first print job.

19. The image forming apparatus according to claim 18, wherein the controller displays options whether or not to execute the second print job prior to the first print job on a display device.

20. The image forming apparatus according to claim 19, wherein the image forming apparatus comprises the display device.

21. The image forming apparatus according to claim 18, wherein in a case where the controller receives an instruction which indicates that the second print job should not be executed prior to the first print job, the controller executes the first print job prior to the second print job after the second fixing device is attached, and wherein in a case where the controller receives an instruction which indicates that the second print job should be executed prior to the first print job, the controller executes the second print job prior to the first print job without exchange of fixing devices.

22. An image forming apparatus comprises:

an image forming device configured to form, on a sheet, a toner image to execute a print job;

a fixing device configured to fix the toner image formed on the sheet by the image forming device, the fixing device being exchangeable with another fixing device;

a storage unit configured to store information which corresponds to a sheet size which is permitted for a fixing process to be executed by the fixing device; and a controller configured to acquire, from the storage unit, the information which corresponds to a sheet size which is permitted for a fixing process to be executed by a currently-attached fixing device, wherein in a case where a first print job for forming a toner image on a sheet having a sheet size that does not coincide with the sheet size presented by the information acquired by the controller, and a second print job for forming a toner image on a sheet having a sheet size that coincides with the sheet size presented by the information acquired by the controller, are continuously input in this order, the controller executes the input print jobs in one mode selected by an operator from among a plurality of modes including a first mode in which the first print job is executed prior to the second print job and a second mode in which the second print job is executed prior to the first print job.

23. The image forming apparatus according to claim 22, wherein the controller urges an operator to select one mode from among the plurality of modes.

24. The image forming apparatus according to claim 22, wherein the controller displays options including the first mode and the second mode on a display device.

25. The image forming apparatus according to claim 24, wherein the image forming apparatus comprises the display device.

26. The image forming apparatus according to claim 22, wherein in the first mode, the controller executes the first print job prior to the second print job after a fixing device, which is permitted to use a sheet having a sheet size that coincides with the sheet size of the sheet used for the first print job, is attached.

27. An image forming apparatus comprises:

an image forming device configured to form, on a sheet, a toner image to execute a print job;

a fixing device configured to fix the toner image formed on the sheet by the image forming device, the fixing device being exchangeable with another fixing device;

a storage unit configured to store information on a plurality of sheet sizes permitted for a fixing process to be executed by the fixing device; and a controller configured to acquire, from the storage unit, the information on the plurality of sheet sizes permitted for a fixing process to be executed by a currently-attached fixing device, wherein in a case where a first print job for forming a toner image on a sheet having a sheet size that is not included in the plurality of sheet sizes presented by the information acquired by the controller, and a second print job for forming a toner image on a sheet having a sheet size that is included in the plurality of sheet sizes presented by the information acquired by the controller, are continuously input in this order, the controller executes the input print jobs in one mode selected by an operator from among a plurality of modes including a first mode in which the first print job is executed prior to the second print job and a second mode in which the second print job is executed prior to the first print job.

28. The image forming apparatus according to claim 27, wherein the controller urges an operator to select one mode from among the plurality of modes.

29. The image forming apparatus according to claim 27, wherein the controller displays options including the first mode and the second mode on a display device.

30. The image forming apparatus according to claim 29, wherein the image forming apparatus comprises the display device.

31. The image forming apparatus according to claim 27, wherein in the first mode, the controller executes the first print job prior to the second print job after a fixing device, which is permitted to use a sheet having a sheet size that coincides with the sheet size of the sheet used for the first print job, is attached.

32. An image forming apparatus comprises:

an image forming device configured to form, on a sheet, a toner image to execute a print job;

a first fixing device configured to fix the toner image formed on the sheet by the image forming device, the first fixing device being permitted to execute a fixing process on the sheet of a predetermined type not including a predetermined envelope, wherein the first fixing device is exchangeable with a second fixing device configured to fix the toner image formed on the sheet by the image forming device and is permitted to execute a fixing process on the sheet of a predetermined type including the predetermined envelope; and a controller configured to, in a case where a first print job requiring the second fixing device which is not currently attached on the image forming apparatus and a second print job requiring the first fixing device which is currently attached on the image forming apparatus are continuously input in this order, execute the input print jobs in one mode selected by an operator from among a plurality of modes including a first mode in which the first print job is executed prior to the second print job and a second mode in which the second print job is executed prior to the first print job.

33. The image forming apparatus according to claim 32, wherein the controller urges an operator to select one mode from among the plurality of modes.

34. The image forming apparatus according to claim 32, wherein the controller displays options including the first mode and the second mode on a display device.

35. The image forming apparatus according to claim 33, wherein the image forming apparatus comprises the display device.

36. The image forming apparatus according to claim 32, wherein in the first mode, the controller executes the first print job prior to the second print job after the second fixing device is attached.

* * * * *